US011545311B2

(12) United States Patent
Zheng et al.

(10) Patent No.: US 11,545,311 B2
(45) Date of Patent: Jan. 3, 2023

(54) ELECTROMAGNETIC SWITCH

(71) Applicant: KEDU ELECTRIC CO., LTD., Yueqing (CN)

(72) Inventors: Chunkai Zheng, Yueqing (CN); Ziping Li, Yueqing (CN); Jun Liao, Yueqing (CN); Dong Chen, Yueqing (CN); Zhixia Tong, Yueqing (CN)

(73) Assignee: KEDU ELECTRIC CO., LTD., Yueqing (CN)

( * ) Notice: Subject to any disclaimer, the term of this patent is extended or adjusted under 35 U.S.C. 154(b) by 147 days.

(21) Appl. No.: 17/010,934

(22) Filed: Sep. 3, 2020

(65) Prior Publication Data

US 2021/0074488 A1 Mar. 11, 2021

(30) Foreign Application Priority Data

Sep. 11, 2019 (CN) ..... 201910858174.4
Dec. 31, 2019 (CN) ..... 201911425950.8

(51) Int. Cl.
*H01H 3/28* (2006.01)
*H01H 3/12* (2006.01)
(Continued)

(52) U.S. Cl.
CPC ..... *H01H 3/28* (2013.01); *H01H 3/12* (2013.01); *H01H 5/06* (2013.01); *H01H 9/24* (2013.01)

(58) Field of Classification Search
CPC .. H01H 3/28; H01H 3/12; H01H 5/06; H01H 9/24; H01H 50/643; H01H 50/326
(Continued)

(56) References Cited

U.S. PATENT DOCUMENTS 718,678 A * 1/1903 Tomb ..... B60L 5/14 191/90
1,238,719 A * 8/1917 Sweet et al. ..... H01H 51/12 192/142 R
(Continued)

FOREIGN PATENT DOCUMENTS

CN 201 289 823 Y 8/2009
CN 110491694 A 11/2019
(Continued)

OTHER PUBLICATIONS

Communication European Search Report dated Jan. 14, 2021 in connection with European Application No. 20194789.2.

*Primary Examiner* — Shawki S Ismail
*Assistant Examiner* — Lisa N Homza
(74) *Attorney, Agent, or Firm* — Amster, Rothstein & Ebenstein LLP

(57) ABSTRACT

The present application relates to the field of switch technology, in particular to an electromagnetic switch, comprising a housing, a jump mechanism, movably arranged on the housing; a trip mechanism, arranged on the housing and opposite to the jump mechanism, and comprising a bridge plate located on a moving path of the jump mechanism and having multiple locked states, unlocked states, and critical states; The present application further provides another electromagnetic switch, comprising: a housing, an electromagnetic component, a contact mechanism and an armature, two spring buttons are arranged in parallel on the housing, a first spring button is internally provided with a jump structure for providing resistance at a start moment when the first spring button is pressed; in the electromagnetic switch of the present application, a jump structure is arranged on the spring button above the electromagnetic component.

3 Claims, 23 Drawing Sheets

(51) Int. Cl.
*H01H 5/06* (2006.01)
*H01H 9/24* (2006.01)
*H01H 50/54* (2006.01)

(58) Field of Classification Search
USPC ..... 335/2
See application file for complete search history.

(56) References Cited

U.S. PATENT DOCUMENTS 1,630,650 A * 5/1927 Bliss ..... H01H 73/44 335/174
1,750,895 A * 3/1930 Leyhausen ..... H01H 73/44 335/196
2,396,972 A * 3/1946 Russell ..... H01H 51/12 318/381
2,740,495 A * 4/1956 Santini ..... B66B 1/20 187/382
3,235,686 A * 2/1966 Gribble ..... H01H 50/22 335/132
3,335,375 A * 8/1967 Fujita ..... H01H 75/10 335/40
3,354,415 A * 11/1967 Gribble ..... H01H 50/045 335/131
3,495,342 A * 2/1970 Goldstein ..... H01H 50/88 200/34
4,604,596 A * 8/1986 Yokoyama ..... H01H 89/10 335/14
4,808,953 A * 2/1989 Iio ..... H01H 71/7418 335/176
4,969,834 A * 11/1990 Johnson ..... H01R 13/6691 320/105
2004/0086403 A1* 5/2004 Dokas ..... F04D 13/06 417/423.3

FOREIGN PATENT DOCUMENTS

DE 197 25 202 A1 12/1998
EP 2 187 419 A2 5/2010
EP 2 216 419 B1 7/2014

* cited by examiner

ELECTROMAGNETIC SWITCH

CROSS REFERENCE

The present application the priority of Chinese patent application 2019108581744 filed on Sep. 11, 2019 and Chinese patent application 2019114259508 filed on Dec. 31, 2019, the entire contents of the above patent applications are incorporated herein by reference.

TECHNICAL FIELD

The present application relates to the field of switch technology, in particular to an electromagnetic switch.

BACKGROUND

Electromagnetic switch, as the name implies, is a switch controlled by an electromagnet, and is thus a combination of an electromagnet and a switch. When energized, the electromagnet coil generates electromagnetic attraction, and a movable iron core pushes or pulls switch contacts for connection, and the controlled circuit is switched on. The electromagnetic switch is applied widely in various industries.

In the prior art, such as Chinese patent document CN110491694A, an electromagnetic switch is disclosed, including a housing, an electromagnetic component, a contact mechanism and an armature, the housing is provided with two spring buttons connected in parallel, the first button is internally provided with a jump mechanism for providing a resistance at the beginning of pressing the first button. In the above patented electromagnetic switch, a jump mechanism is arranged on the spring button above the electromagnetic component. When being pressed down by a force not sufficient enough, the spring button is unable to move down, causing the electromagnetic component to produce no attraction force, and the contact will not be in a state very close to be connected. Only when the pressing force on the button is enough to overcome the resistance of the jump mechanism, can the button move downward, and once the button surmounts the resistance of the jump mechanism, the resistance will no longer by produced be the jump mechanism to the button. The button can be pressed down to reach the final position quickly once for all due to inertia, allowing the contacts to be connected, effectively avoiding the arcing phenomenon. In the electromagnetic switch of the patent document, the pressing force applied to the button is required to be sufficient to overcome the resistance by the jump mechanism before the circuit can be connected, demanding a great effort.

In addition, when the electromagnetic switch is applied to the switch of the power tool, the electromagnetic switch is generally used to maintain the connected position of the switch, and the action of closing the circuit is still manually conducted. When performing the switching-on operation, manual pressing operation is needed before the circuit is connected, and the electromagnetic coil is not energized, generating no electromagnetic force at this time. Therefore, in order to ensure that the circuit can be quickly connected, it is necessary to quickly press the switch into place.

However, in actual operation, due to the operating habits of personnel, it is often impossible to quickly press the switch into place at once, the electrical contacts tend to be in a state very close to be connected, facilitating the generation of arcing, which is easy to burn the contact mechanism.

SUMMARY

To solve the above questions, a first aspect of the present application provides an electromagnetic switch, comprising: a housing; a jump mechanism, movably arranged on the housing; a trip mechanism, arranged on the housing and opposite to the jump mechanism, adapted to move relative to the housing, and comprising a bridge plate located on a moving path of the jump mechanism and having multiple locked states, unlocked states, and critical states when shifting from the locked state to the unlocked state; the jump mechanism is adapted to abut against the bridge plate when moving downward, push the bridge plate to move to the locked state, store energy by continuing moving to drive the trip mechanism to move to the critical state, and cause the jump mechanism to jump to connect a circuit with the energy stored in the unlocked state.

The jump mechanism comprises a jump body, a push rod fixedly arranged on the jump body, and a jump lever connected with the jump body through a jump biasing member; the trip mechanism further comprises a first trip frame located on a moving path of the push rod, the bridge plate is arranged on a moving path of the jump lever, and the bridge plate is in a first locked state when the first trip frame abuts against the bridge plate; the jump lever is adapted to abut against the bridge plate and push the bridge plate to move to the first locked state when the jump mechanism moves downward; the push rod is adapted to drive the first trip frame to move via continuing movement of the jump mechanism; and the jump biasing member is adapted to store energy during movement to the critical state, and cause the jump lever to jump to connect the circuit with the energy stored in the unlocked state.

The push rod is fixedly arranged at the middle of the jump body, the jump lever is sleeved on the push rod, the jump biasing member is a jump spring sleeved on the push rod, with one end abutting against the jump lever, and the other end connected with the jump body.

The jump lever comprises a cylindrical connecting end in sleeve connection with the push rod, and an abutting end formed from a side wall of the cylindrical connecting end extending downward, and a cylinder of the cylindrical connecting end is internally provided with the jump spring.

The push rod is connected with the jump body via a screw or riveting pressure.

The push rod is integrally formed with the jump body, an end of the push rod away from the jump body is provided with multiple guide protrusions; the jump lever is provided with multiple guide holes for multiple guide protrusions to pass through, as well as a support surface, and the support surface is adapted to abut against the guide protrusion after the push rod rotates over a preset angle.

The first trip frame and the bridge plate are rotatably mounted on the housing respectively through a pin.

An upper surface of the bridge plate is provided with a first curved surface, and a second curved surface in stepped connection with the first curved surface, the first curved surface is located on one side near the second curved surface, a height of the first curved surface is greater than that of the second curved surface, a step face between the first curved surface and the second curved surface is a first locked face, one end of the first trip frame moves on the first curved surface and the second curved surface and is adapted to be fitted on the first locked face.

The jump body is a first button arranged on the housing which is internally provided with a further second button in parallel with the first button, one end of a second trip frame of the trip mechanism is located on a moving path of the second button; the second trip frame is adapted to abut against the bridge plate after connection of the circuit, causing the bridge plate to be in a second locked state, and continues moving when the second button presses the second trip frame to move to the critical state, causing the bridge plate to be in the unlocked state.

The second trip frame and the first trip frame are rotatably mounted on the housing with a pin, the second trip frame is provided with a fastening face via which the second trip frame is locked with the bridge plate, the bridge plate is provided with a step-like second locked face and is in the second locked state after the fastening face is fitted with the second locked face.

The second trip frame and the first trip frame are connected through a torsion spring, a torsion force applied on the second trip frame increases when the first trip frame is driven to rotate by the push rod (24) in the second locked state.

The electromagnetic switch further comprises a base for arranging the trip mechanism, the base is fixedly mounted in the housing and provided with two pairs of mounting holes in step-like arrangement, both ends of the two pins are respectively mounted in the corresponding mounting holes.

The electromagnetic switch further comprises an electromagnetic component, arranged corresponding to the first button; an armature, with one end located between the electromagnetic component and the jump mechanism, the other end rotatably connected on the electromagnetic component or the housing through a tension spring, and is adapted to move towards the electromagnetic component driven by the jump lever, to be connected with the electromagnetic component; and a contact mechanism, arranged corresponding to the second button, comprising a moving contact holder, one end of the bridge plate extends into the moving contact holder having an upper end located on the moving path of the second button, and the bridge plate drives the moving contact holder to move to connect the circuit.

An abutting end of the jump lever comprises a bridge plate abutting end abutting against the bridge plate, and an armature abutting end abutting against the armature, a height of the bridge plate abutting end is smaller than that of the armature abutting end.

The second button comprises a first pressing end abutting against the second trip frame, and a second pressing end abutting against an upper end of the moving contact holder and arranged in parallel with the first pressing end.

The above technical solutions of the present application have the following advantages:

1. The electromagnetic switch of the present application comprises a housing, a jump mechanism, movably arranged on the housing; a trip mechanism, arranged on the housing and opposite to the jump mechanism, adapted to move relative to the housing, and comprising a bridge plate located on a moving path of the jump mechanism and having multiple locked states, unlocked states, and critical states when shifting from the locked state to the unlocked state; the jump mechanism is adapted to abut against the bridge plate when moving downward, push the bridge plate to move to the locked state, store energy by continuing moving to drive the trip mechanism to move to the critical state, and cause the jump mechanism to jump to connect a circuit with the energy stored in the unlocked state. The energy stored by the jump mechanism enables the jump mechanism and the trip mechanism to act swiftly to connect the circuit effectively and rapidly, avoiding the scenario that the circuit is in a state very close to be connected, effectively preventing the occurrence of arcing, and increasing the service life of the electromagnetic switch; and the electromagnetic switch is connected through release of the energy stored by the jump mechanism, free of human interference, making the switching-on action more reliable.

2. In the electromagnetic switch of the present application, the arrangements of the push rod, the jump lever and the jump spring are simple and stable in structure, facilitating processing and manufacturing.

3. In the electromagnetic switch of the present application, the push rod and the jump body are in threaded or riveted connection which is simple and convenient, and the connection to the jump lever is more stable.

4. In the electromagnetic switch of the present application, after connection of the circuit, the second trip frame abuts against the bridge plate to cause the bridge plate to be in a second locked state, enabling the electromagnetic switch to be in a stable connection state.

A second aspect of the present application provides an electromagnetic switch, comprising:

a housing, with two spring buttons arranged in parallel thereon;

an electromagnetic component, arranged in the housing and opposite to the first spring button;

a contact mechanism, arranged in the housing and opposite to a second spring button;

an armature, rotatably connected inside the housing, with one end extending to one side of the first spring button and the other end extending to one side of the second spring button; and the first spring button is internally provided with a jump structure for providing resistance at a start moment when the first spring button is pressed.

In a preferred solution, the jump structure comprises:

a blocker, laterally connected inside a push bar of the first spring button through a spring, having a curved structure protruding out of the push bar; and a boss, arranged on a sliding path of the push bar and adapted to get in contact with the curved structure of the blocker.

In a preferred solution, the blocker has a spherical or conical shape.

In a preferred solution, the electromagnetic switch comprises multiple blockers on the push bar.

In a preferred solution, the multiple blockers are evenly arranged along a circumference of the push bar.

Ina preferred solution, the contact mechanism comprises:

a static contact group, fixedly arranged in the housing;

a moving contact holder, connected inside the housing, adapted to move up and down relative to the static contact group, and internally and flexibly connected with a moving contact group; and a first elastic member, connected between the moving contact holder and the housing, adapted to provide biasing pressure for moving the moving contact holder away from the second spring button.

In a preferred solution, the moving contact group comprises:

a first moving contact group, flexibly connected with the moving contact holder through a second elastic member;

a second moving contact group, flexibly connected with the moving contact holder through a third elastic member;

the first moving contact group is electrically connected with the second moving contact group.

In a preferred solution, the static contact group comprises:

a first static contact group, arranged opposite to the first moving contact group of the moving contact group;

a second static contact group, arranged opposite to the second moving contact group of the moving contact group; and a brake static contact group, arranged on the other side of the first moving contact group away from the first static contact group, and sharing the same first moving contact group with the first static contact group.

In a preferred solution, each of the first moving contact group, the first static contact group and the brake static contact group has two symmetrical electrical contacts.

In a preferred solution, two electrical contacts of the brake static contact group are configured to be respectively and electrically connected to two terminals of a drive motor.

The above technical solutions of the present application have the following advantages:

1. In the electromagnetic switch provided by the present application, the jump structure is arranged on the spring button above the electromagnetic component, when being pressed downward with a force not sufficient enough, the spring button is unable to move downward, failing to cause the electromagnetic component to generate a suction force, thus the contacts would not be in a state very close to be connected; only when the pressing force on the button is sufficient to overcome the resistance of the jump structure, can the button move downward, and once the button overcomes the resistance of the jump structure, the jump structure will no longer produce resistance to the button. The spring button can be pressed quickly in one push to reach the final position due to inertia, so that the contacts are connected, effectively avoiding the arcing phenomenon and increasing the service life of the electromagnetic switch.

2. In the electromagnetic switch provided by the present application, the structures of the boss and the blocker are used to block the push bar of the spring button, thus the resistance brought by the structures of the boss and the blocker vanishes after the push bar overcomes the resistance, and the push bar maintains a large inertia during the movement over subsequent moving sections.

3. In the electromagnetic switch provided by the present application, by setting multiple blockers on the push bar evenly, the push bar can be kept vertical during the movement and not opt to shift.

4. The electromagnetic switch provided by the present application is provided with a brake contact group, wherein a brake static contact group and first static contact group share a moving contact group, the design of which can reduce the number of the moving contact group and reduce the volume of contact mechanism.

5. In the electromagnetic switch provided by the present application, the two electrical contacts of the brake contact group are used to be electrically connected to the two terminals of a drive motor. When operation of the drive motor is finished, it is disconnected from a power source, but at this time, the self-rotation of the motor will produce a large instantaneous armature current; through the contact of the moving contact group and the brake contact group, the two electrical contacts of the brake contact group are electrically connected to short-circuit the terminals at both ends of the motor, thereby preventing the motor from continuing to rotate due to inertia and generating a large armature current, and protecting the contacts of the switch from being burned out.

BRIEF DESCRIPTION OF THE DRAWINGS

In order to make a clearer description of technical solutions in specific implementations of the present invention or prior art, drawings involved in description for the specific implementations or the prior art will be briefly introduced, and apparently, the drawings described below illustrate some implementations of the present invention, for one with ordinary skill in the art, other drawings can also be obtained in accordance with these drawings without delivering creative efforts.

DESCRIPTION FOR NUMERAL REFERENCES

Figure 1:
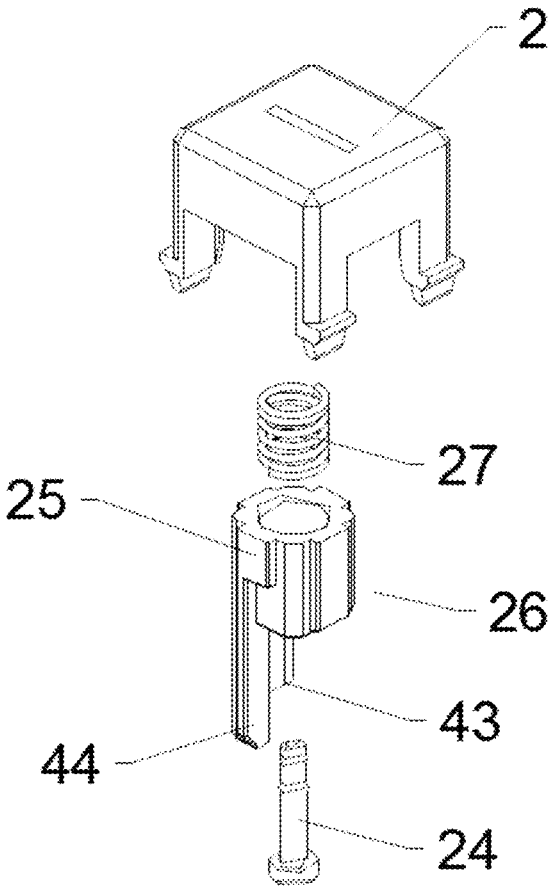
FIG. 1 is an exploded view of a first embodiment of a jump mechanism of an electromagnetic switch provided by a first aspect of the present application.

1—housing; 2—first button; 3—second button; 4—electromagnetic component; 5—coil; 6—iron core; 7—armature; 8—moving contact holder; 9—first elastic member; 10—first moving contact group; 11—first static contact group; 12—second moving contact group; 13—second static contact group; 14—brake static contact group; 17—jump body; 18—panel; 19—second elastic member; 20—third elastic member; 23—restoration spring; 24—push rod; 25—cylindrical connecting end; 26—jump lever; 27—jump spring; 28—tension spring; 29—guide protrusion; 30—guide hole; 31—support surface; 32—bridge plate; 33—first trip frame; 34—first curved surface; 35—second curved surface; 36—first locked face; 37—first locking end; 38—second trip frame; 39—second locked face; 40—fastening face; 41—torsion spring; 42—pin; 43—bridge plate abutting end; 44—armature abutting end; 45—first pressing end; 46—second pressing end; 47—base; 81—housing; 82—first spring button; 83—second spring button; 84—electromagnetic component; 85—coil; 86—iron core; 87—armature; 88—moving contact holder; 89—first elastic member; 810—first moving contact group; 811—first static contact group; 812—second moving contact group; 813—second static contact group; 814—brake static contact group; 815—steel ball; 816—boss; 817—push bar; 818—panel; 819—second elastic member; 820—third elastic member; 821—fixing base; 822—base.

DETAILED DESCRIPTION

Technical solutions of the present invention will be described clearly and completely as follows in conjunction with the drawings, apparently, the described embodiments are just part rather than all embodiments of the present invention. Based on the embodiments in the present invention, all other embodiments obtained by one with ordinary skill in the art without delivering creative efforts shall fall into the protection scope of the present invention.

In the description of the present invention, it should be noted that, orientation or position relationships indicated by terms such as "centre", "upper", "lower", "left", "right", "vertical", "horizontal", "inner", "outer", etc. are orientation or position relationships indicated on the basis of the accompanying drawings, are only intended to facilitate description or simplified description of the present invention, rather than indicating or implying that the involved apparatus or element shall have specific orientations, or be configured and operated specifically, and therefore shall not be construed as limitations to the present invention. In addition, terms such as "first", "second", "third", which are merely intended to deliver description, can not be construed as indicating or implying relative importance.

In the description of the present invention, it should be noted that, unless specified and defined otherwise, the terms of "installation", "interconnection" and "connection" shall be understood in a broad sense, for example, a fixed connection, a removable connection, an integral connection, a mechanical connection, an electrical connection, a direct connection, an indirect connection via intermediate medium, or further, internal communication between two elements, a wireless connection, or a wired connection. Case-by-case interpretation can be made to the above terms in the present invention by one with ordinary skill in the art.

Moreover, technical features involved in different implementations described in the present invention below may be combined with each other as long as no conflicts occur therebetween.

As shown in FIGS. 1-33, an embodiment of the electromagnetic switch of the present application comprises a housing 1, a first button 2 arranged in the housing 1, a second button 3, a jump mechanism, a trip mechanism, an electromagnetic component 4, an armature 7 and a contact mechanism.

The housing 1 may comprise a panel 18 and a base, the panel 18 is fixedly connected to the top of the base by plugging. The first button 2 and the second button 3 are arranged in parallel on the panel 18, and a restoration spring 23 is connected between the first button 2, the second button 3 and the panel 18. After being pressed, the first button 2 and the second button 3 can be restored to the initial un-pressed state due to the restoration force of restoration spring 23.

The jump mechanism is movably arranged on the housing 1. As shown in FIGS. 1-8, the jump mechanism comprises a jump body 17, a push rod 24 fixedly arranged on the jump body 17, and a jump lever 26 connected with the jump body 17 through a jump biasing member; the jump lever 26 is sleeved on the push rod 24, the jump biasing member is a jump spring 27 sleeved on the push rod 24, with one end abutting against the jump lever 26 and the other end abutting against the jump body 17.

Figure 2:
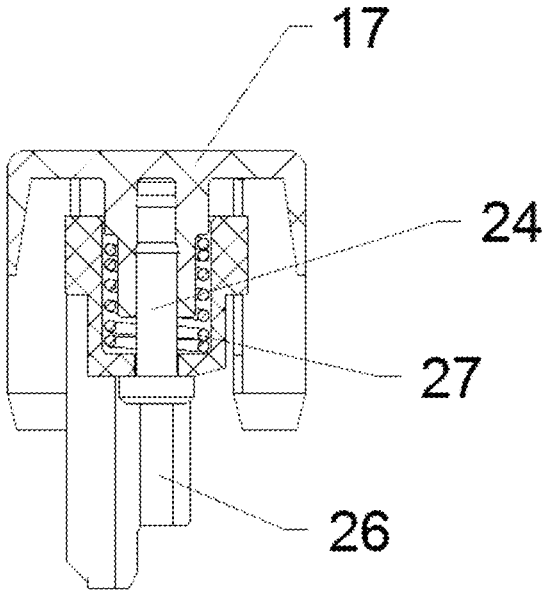
FIG. 2 is a schematic cross-sectional view of a first embodiment of a jump mechanism of an electromagnetic switch provided by a first aspect of the present application.
Figure 3:
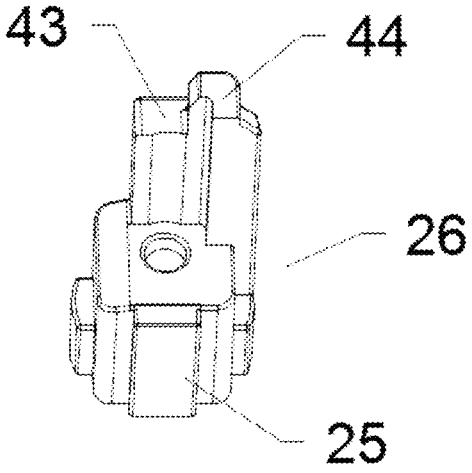
FIG. 3 is a perspective view of a jump lever in the first embodiment of the electromagnetic switch provided by the first aspect of the present application.
Figure 4:
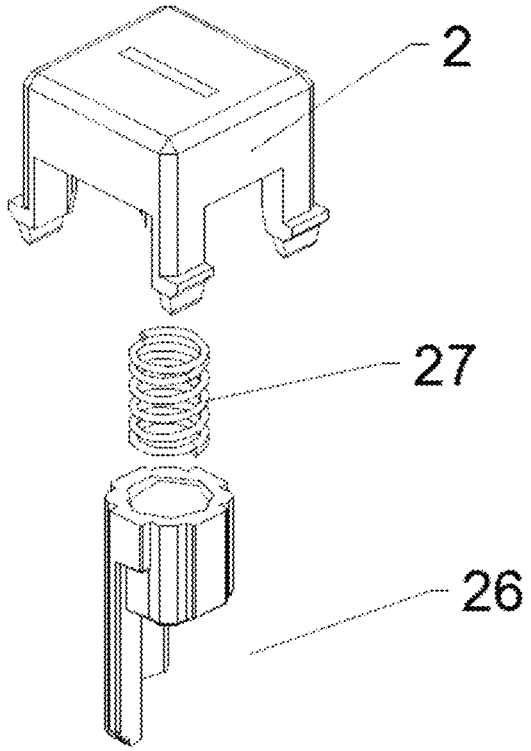
FIG. 4 is an exploded view of a jump mechanism of a second embodiment of an electromagnetic switch provided by the first aspect of the present application.
Figure 5:
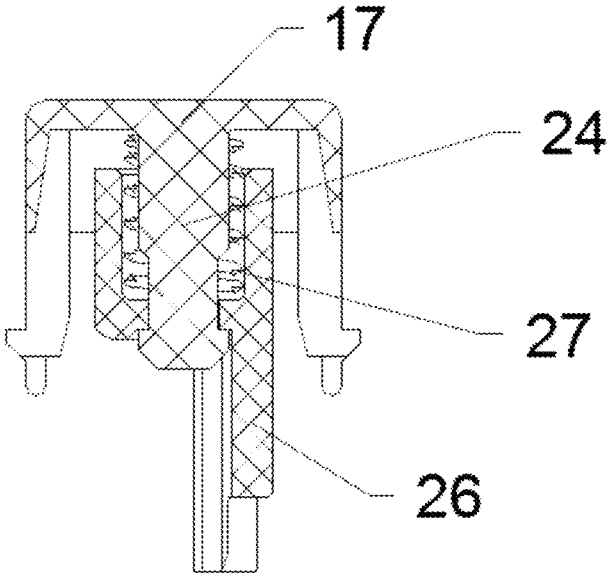
FIG. 5 is a schematic cross-sectional view of the jump mechanism of the second embodiment of the electromagnetic switch provided by the first aspect of the present application.
Figure 6:
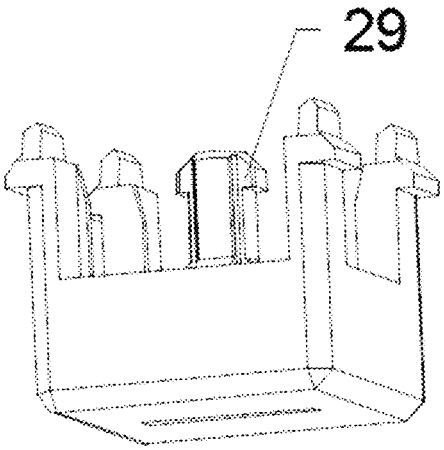
FIG. 6 is a schematic structural view of a perspective view of a first button in a second embodiment of an electromagnetic switch provided by the first aspect of the present application.
Figure 7:
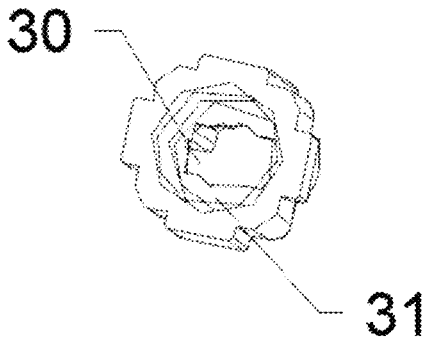
FIG. 7 is a first perspective view of a jump lever in the second embodiment of the electromagnetic switch provided by the first aspect of the present application.

In this embodiment, as shown in FIGS. 1-3, the push rod 24 is connected with the jump body 17 via a screw or riveting pressure, while the jump lever 26 is provided with holes for the push rod 24 to pass through, and after the jump spring 27 and the jump lever 26 are connected, the push rod 24 is connected with the jump body 17 via a screw or riveting pressure.

As an alternative embodiment, as shown in FIGS. 4-8, the push rod 24 is integrally formed with the jump body 17, an end of the push rod 24 away from the jump body 17 is provided with multiple guide protrusions 29; the jump lever 26 is provided with multiple guide holes 30 for multiple guide protrusions 29 to pass through, as well as a support surface 31, and the support surface 31 is adapted to abut against the guide protrusion 29 after the push rod 24 rotates over a preset angle. After the jump spring 27 is connected with the jump lever 26, the guide protrusions 29 correspond to the guide holes 30, and the push rod 24 passes through guide hole 30 before rotating over a preset angle, the guide protrusions 29 and support surface 31 rely on the jump spring 27 to abut against each other for connection. Of course, in order to prevent the guide protrusions 29 from moving out of the support surface 31, a blocking protrusion may be arranged to prevent the guide protrusions 29 from moving out, or the support surface 31 may be arranged with a certain angle. In this embodiment, two guide protrusions 29 and two guide holes 30 are respectively arranged.

Figure 8:
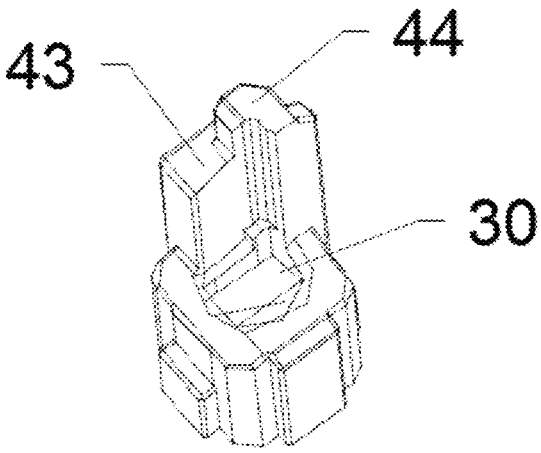
FIG. 8 is a second perspective view of the jump lever in the second embodiment of the electromagnetic switch provided by the first aspect of the present application.
Figure 9:
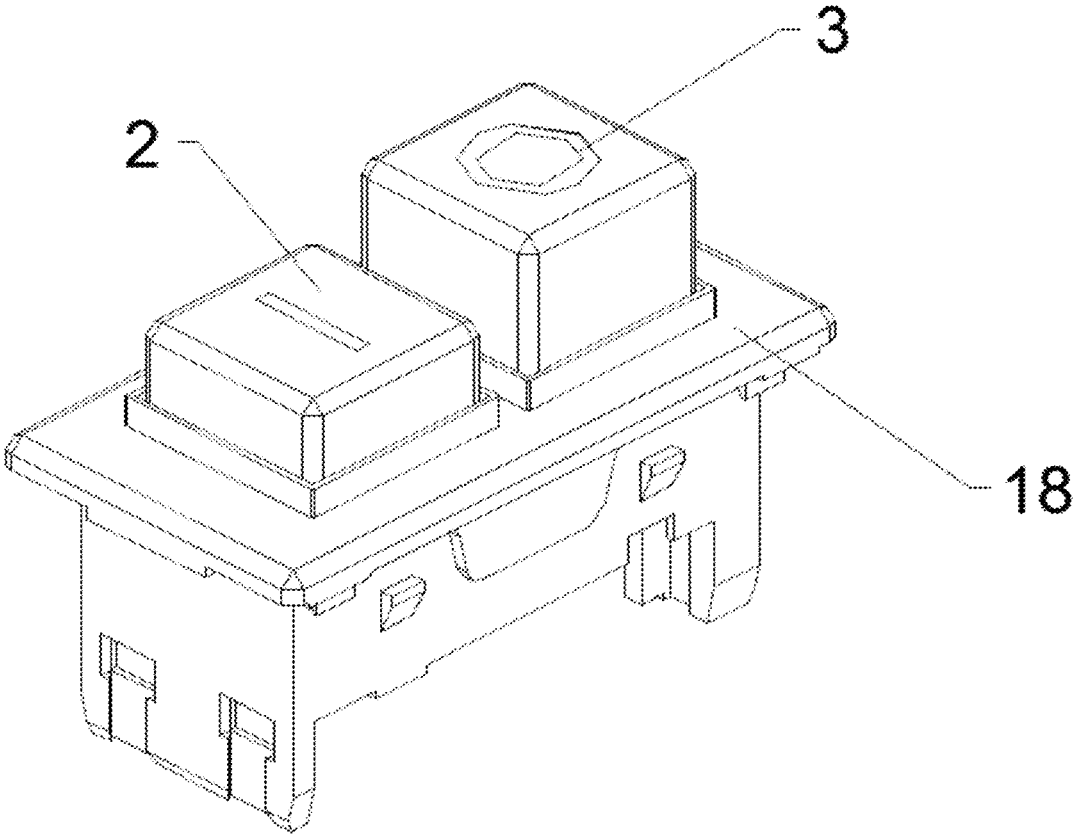
FIG. 9 is a perspective view of the electromagnetic switch panel provided by the first aspect of the present application.
Figure 10:
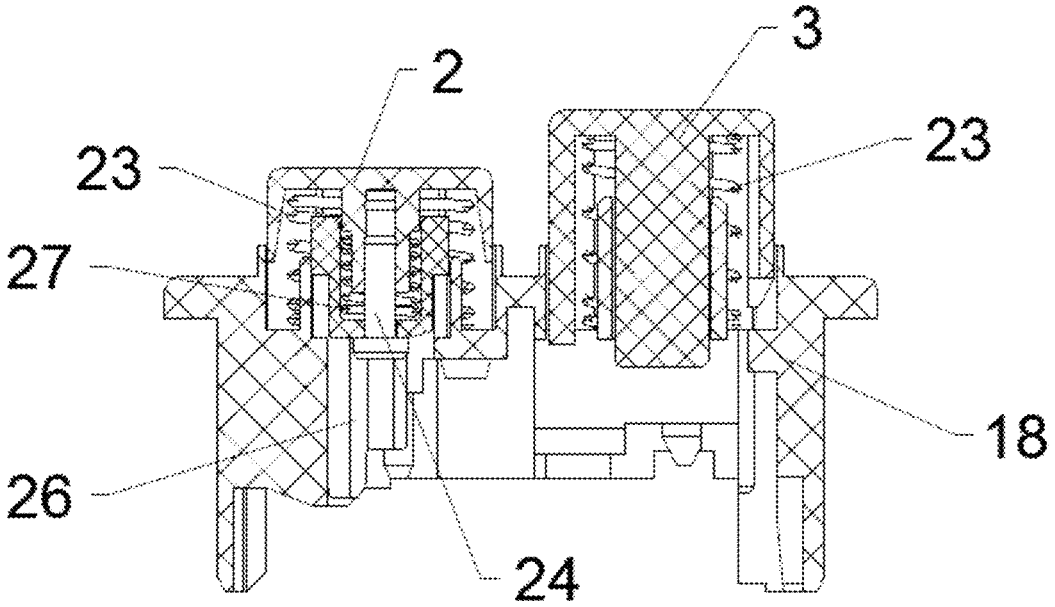
FIG. 10 is a schematic cross-sectional view at a panel of the electromagnetic switch provided by the first aspect of the present application.
Figure 11:
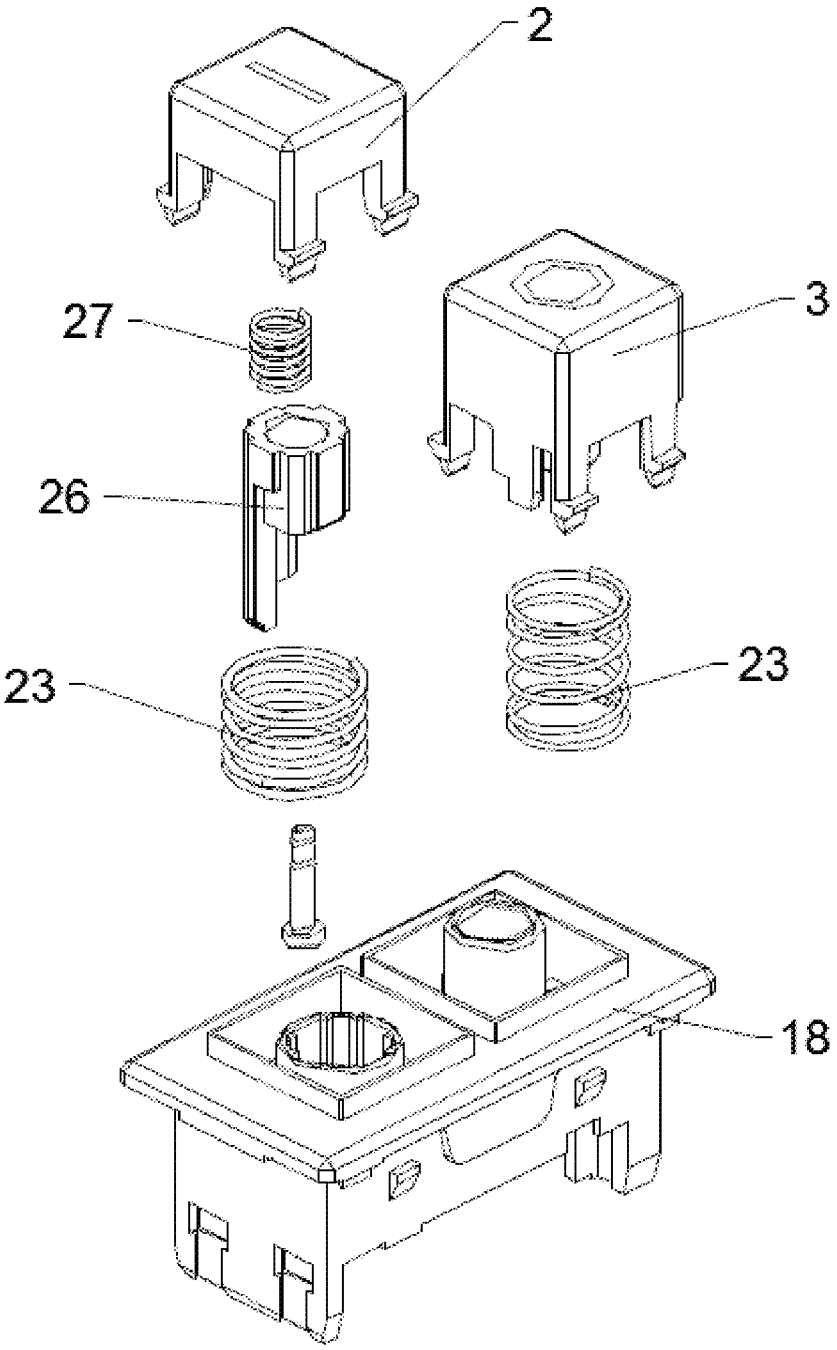
FIG. 11 is a schematic structural diagram of an explosion diagram at the panel of the electromagnetic switch provided by the first aspect of the present application.
Figure 12:
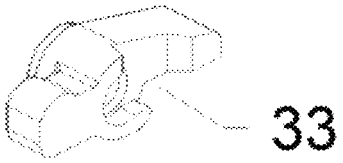
FIG. 12 is a schematic structural diagram of a perspective view of a first trip frame of the electromagnetic switch provided by the first aspect of the present application.
Figure 13:
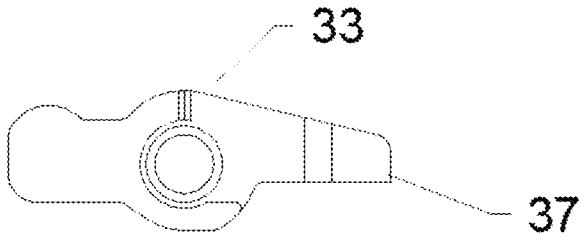
FIG. 13 is a schematic structural view of a front view of the first trip frame of the electromagnetic switch provided by the first aspect of the present application.
Figure 14:
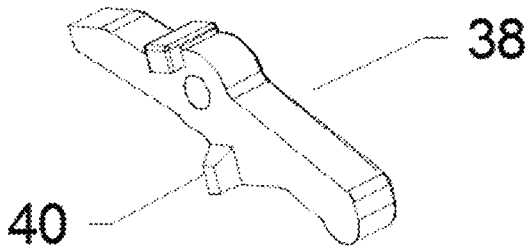
FIG. 14 is a schematic structural diagram of a perspective view of a second trip frame of the electromagnetic switch provided by the first aspect of the present application.
Figure 15:
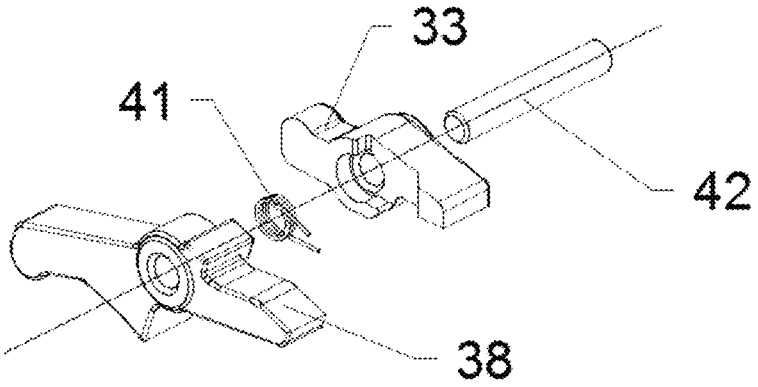
FIG. 15 is a schematic diagram of a connection structure of the first trip frame and second trip frame of the electromagnetic switch provided by the first aspect of the present application.

As shown in FIG. 3 and FIG. 8, the jump lever 26 comprises a cylindrical connecting end 25 in sleeve connection with the push rod 24, and an abutting end formed from a side wall of the cylindrical connecting end 25 extending downward, and a cylinder of the cylindrical connecting end 25 is internally provided with the jump spring 27. The abutting end of the jump lever 26 includes a ridge plate abutting end 43 abutting against the bridge plate 32, and an armature abutting end 44 abutting against the armature 7, and the bridge plate abutting end 43 has a height smaller than that of the armature abutting end 44.

In this embodiment, the jump body 17 is the first button 2 when being used in the electromagnetic switch, and can also be other components moving under pressure when being installed in other devices.

Figure 33:
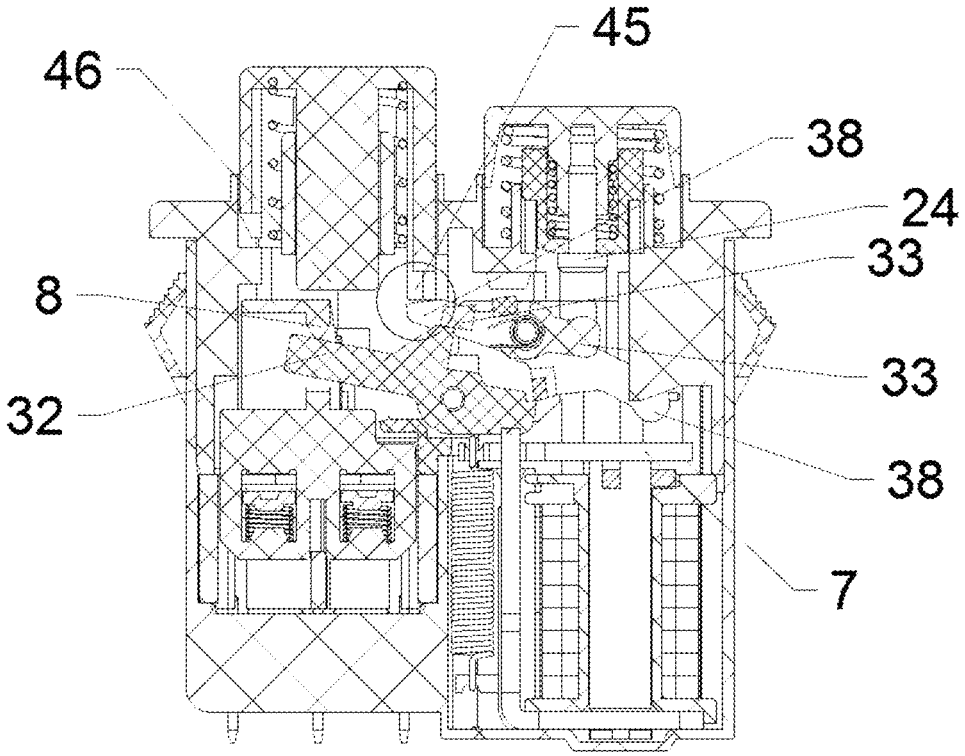
FIG. 33 is a schematic structural view of a cross-sectional view of an electromagnetic switch when the second button is pressed and the trip mechanism is in a critical state in the electromagnetic switch provided by the first aspect of the present application.

As shown in FIG. 33, the second button 3 comprises a first pressing end 45 abutting against the second trip frame 38, and a second pressing end 46 abutting against the moving contact holder 8 and arranged in parallel with the first pressing end 45.

As shown in FIGS. 12-20, the trip mechanism is arranged on the housing 1 and opposite to the jump mechanism, adapted to move relative to the housing 1, and comprises a bridge plate 32, a first trip frame 33 and a second trip frame 38. The bridge plate 32 and the first trip frame 33 are located on a moving path of the jump mechanism, the second trip frame 38 is located on a moving path of the second button 3, and the bridge plate 32 has multiple locked states, unlocked states, and critical states when shifting from the locked state to the unlocked state.

In this embodiment, the first trip frame 33, the second trip frame 38 and the bridge plate 32 are respectively rotatably mounted on the housing 1 through a pin 42, wherein the first trip frame 33 and the second trip frame 38 are arranged with the same pin, two pins 42 are arranged in parallel, the first trip frame 33 and second trip frame 38 are located on an upper side of the bridge plate 32. One end of the first trip frame 33 is located on a moving path of the push rod 24, one end of the bridge plate 32 on the same side as the push rod 24 is located on a moving path of the jump lever 26, the other end of the bridge plate 32 extends into a moving contact holder 8 of the contact mechanism, and the one end of the second trip frame 38 is located on a moving path of the second button 3. When the first trip frame 33 abuts against the bridge plate 32, the bridge plate 32 is in the first locked state; when the second trip frame 38 abuts against the bridge plate 32, the bridge plate 32 is in second locked state.

Figure 16:
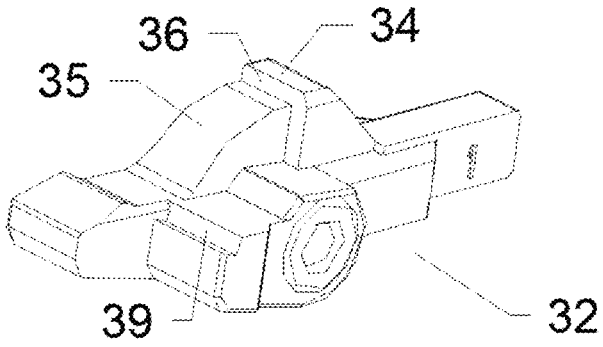
FIG. 16 is a schematic structural view of a perspective view of a bridge plate of the electromagnetic switch provided by the first aspect of the present application.
Figure 26:
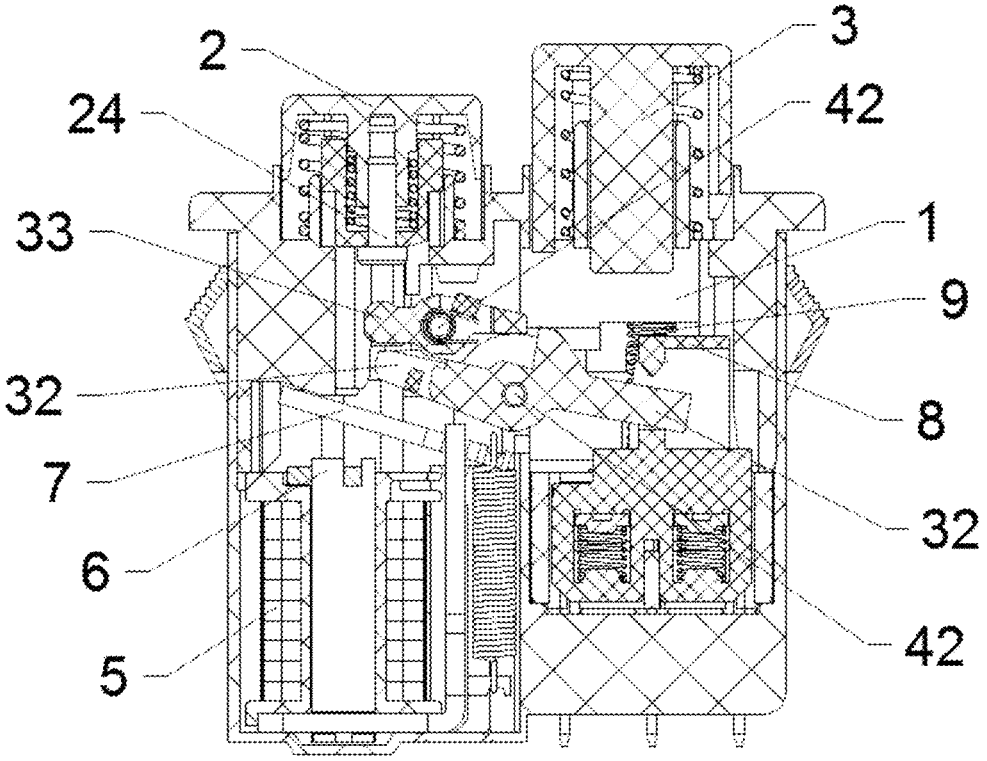
FIG. 26 is a schematic structural view of a cross-sectional view of the electromagnetic switch in an initial state provided by the first aspect of the present application.
Figure 27:
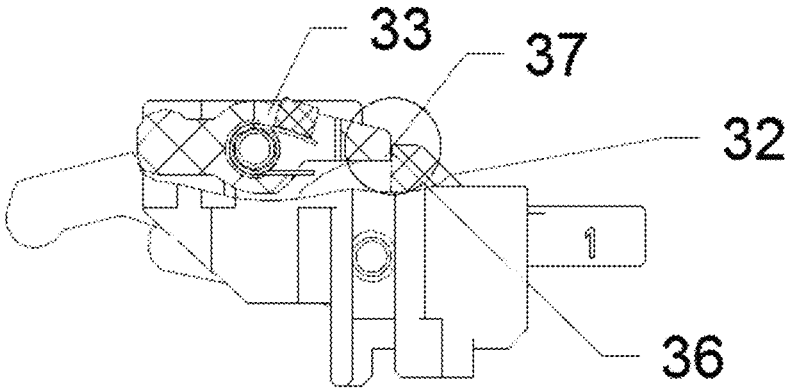
FIG. 27 is a schematic structural view of a cross-sectional view of the trip mechanism of the electromagnetic switch in a first locked state provided by the first aspect of the present application.
Figure 28:
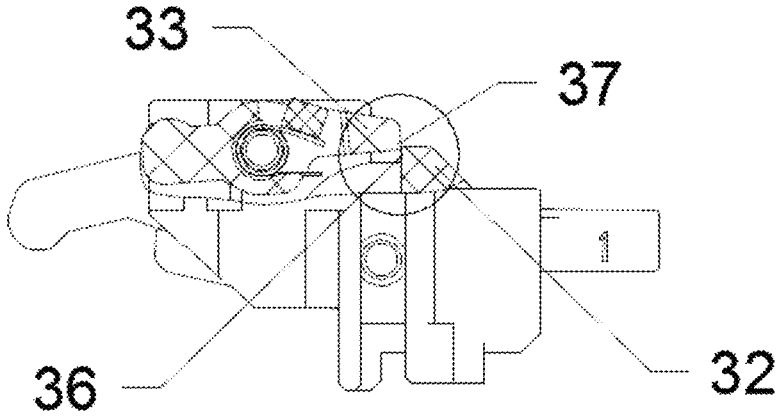
FIG. 28 is a schematic structural view of a cross-sectional view of the first trip frame of the electromagnetic switch in a critical state provided by the first aspect of the present application.
Figure 29:
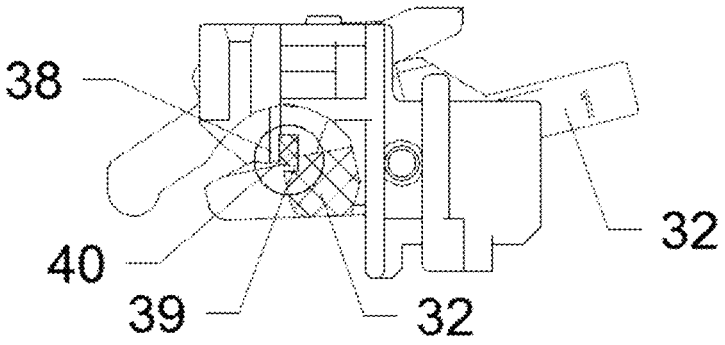
FIG. 29 is a schematic structural view of a cross-sectional view of the trip mechanism of the electromagnetic switch in a second locked state provided by the first aspect of the present application.
Figure 30:
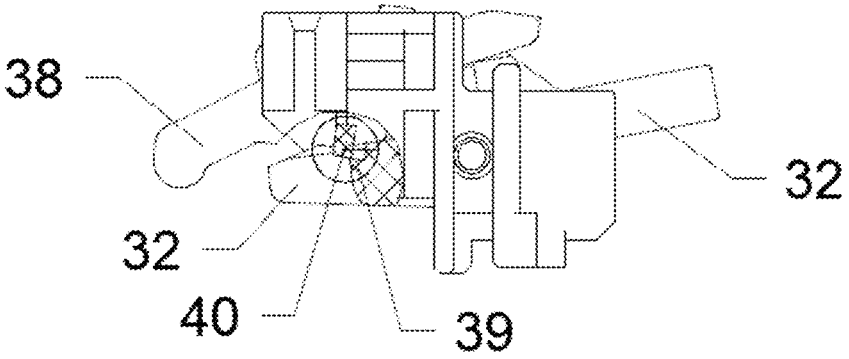
FIG. 30 is a schematic structural view of a cross-sectional view of a second trip frame of the electromagnetic switch in a critical state provided by the first aspect of the present application.
Figure 32:
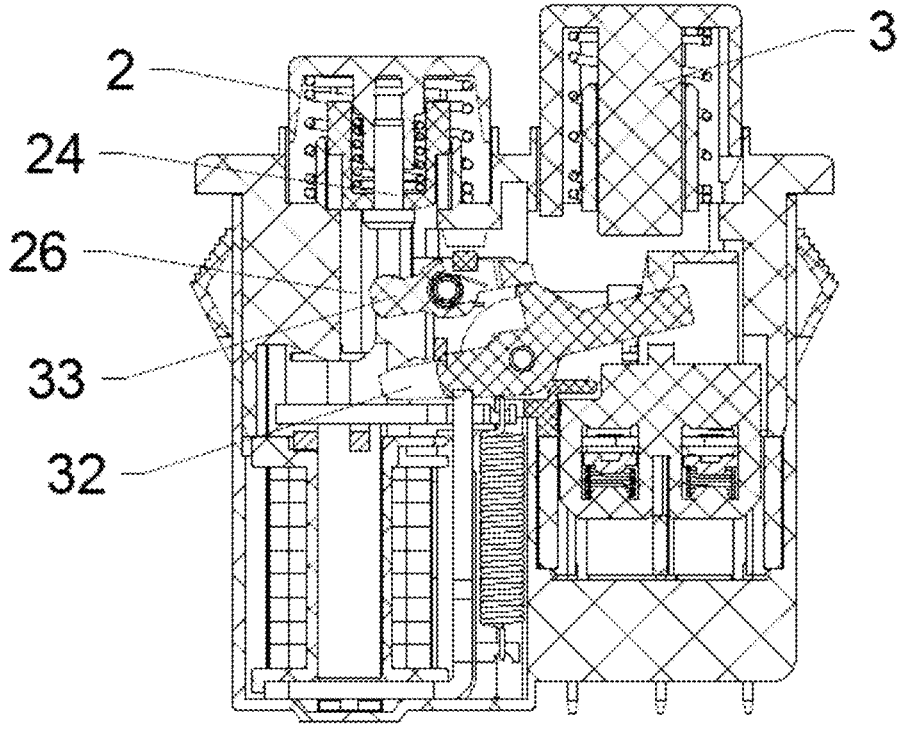
FIG. 32 is a schematic structural view of a cross-sectional view of an electromagnetic switch when the first button is released and the trip mechanism is in the second locked state in the electromagnetic switch provided by the first aspect of the present application.

In this embodiment, as shown in FIG. 16, FIG. 27 and FIG. 28, an upper surface of the bridge plate 32 is provided with a first curved surface 34, and a second curved surface 35 in stepped connection with the first curved surface 34, the first curved surface 34 is located on one side near the second curved surface 35, a height of the first curved surface 34 is greater than that of the second curved surface 35, a step face between the first curved surface 34 and the second curved surface 35 is a first locked face 36, one end of the first trip frame 33 moves on the first curved surface 34 and the second curved surface 35 and is adapted to be fitted on the first locked face 36. When the first locked face 36 is fitted with one end of the first trip frame 33, the bridge plate 32 is in the first locked state. As shown in FIG. 26, FIG. 27, and FIG. 32, in the initial state, one end of the first trip frame 33 is located on the second curved surface 35, in the first locked state, one end of the first trip frame 33 is fitted with the first locked face 36, and in the second locked state, one end of the first trip frame 33 is located on the first curved surface 34.

As shown in FIG. 14, FIG. 15, FIG. 29 and FIG. 30, the second trip frame 38 and the first trip frame 33 are arranged in parallel, and the second trip frame 38 and the first trip frame 33 are connected by a torsion spring 41. In the second locked state, when the first trip frame 33 is driven to rotate by the push rod 24, the torsion force applied on the second trip frame 38 increases, and the locking force between the second trip frame 38 and the bridge plate 32 increases. The second trip frame 38 is provided with a fastening face 40 that is locked with the bridge plate 32, the bridge plate 32 is provided with a stepped second locked face 39, and after the fastening face 40 is attached to the second locked face 39, the bridge plate 32 is in the second locked state. In the second locked state, one end of the second trip frame 38 is arranged close to the armature 7 and can be driven to rotate by the armature 7 to unlock the bridge plate 32; the other end of the second trip frame 38 is located at on a moving path of the second button 3.

Figure 17:
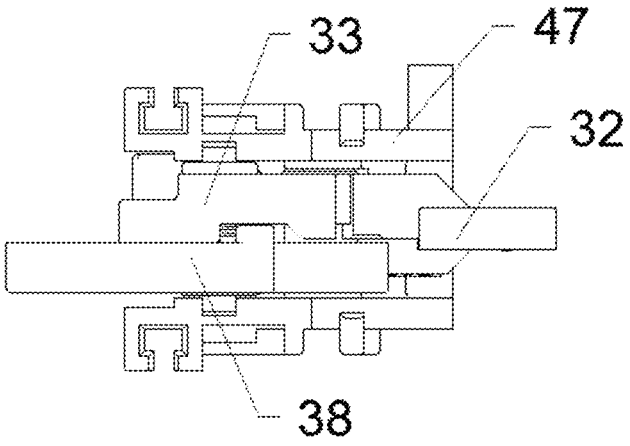
FIG. 17 is a first schematic structural view of a top view of the bridge plate, the first trip frame and the second trip frame of the electromagnetic switch provided by the first aspect of the present application.
Figure 18:
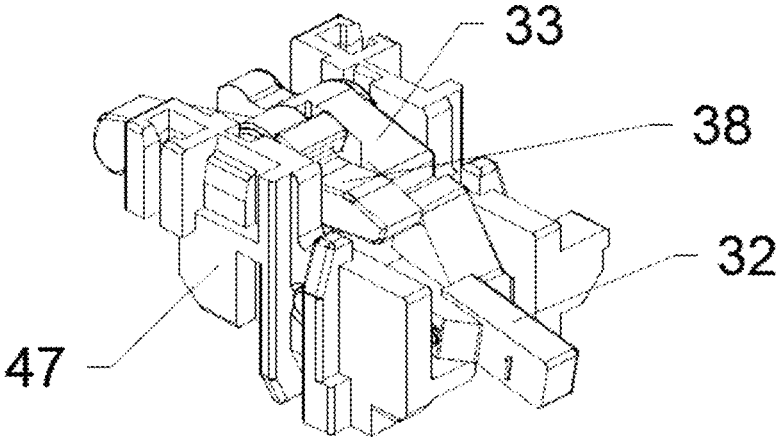
FIG. 18 is a second schematic diagram of a perspective view of the bridge plate, the first trip frame and the second trip frame of the electromagnetic switch provided by the first aspect of the present application.

In this embodiment, as shown in FIG. 17 and FIG. 18, the trip mechanism is arranged on a base 47 which is fixedly installed in the housing 1 and provided with two pairs of mounting holes arranged in a stepped manner, both ends of the two pins 42 are respectively installed in corresponding mounting holes.

The trip mechanism can be arranged at a position according to usage requirements, such as directly arranged on the housing 1, or arranged on the base 47.

Figure 19:
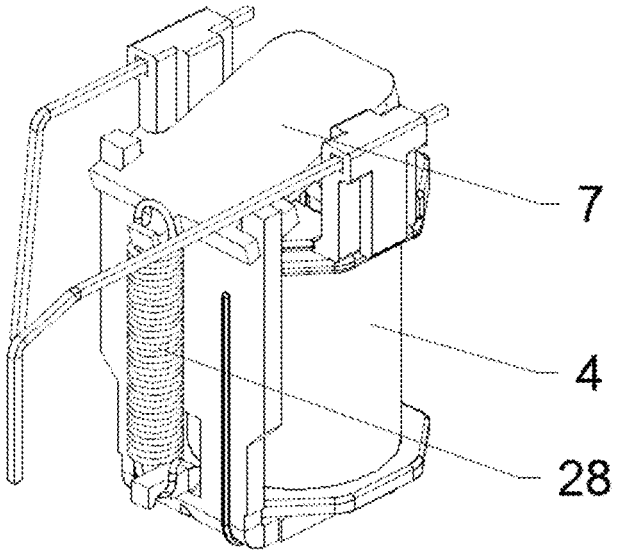
FIG. 19 is a schematic structural view of a perspective view of the electromagnetic component of the electromagnetic switch provided by the first aspect of the present application.
Figure 20:
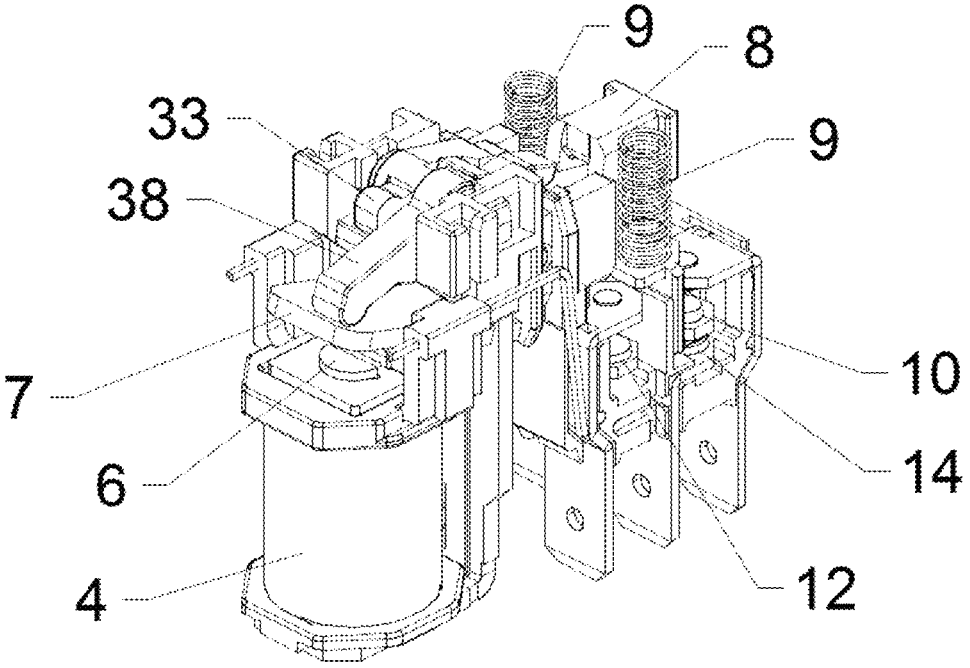
FIG. 20 is a schematic structural view of a perspective view of an electromagnetic component and a contact mechanism of the electromagnetic switch provided by the first aspect of the present application.
Figure 21:
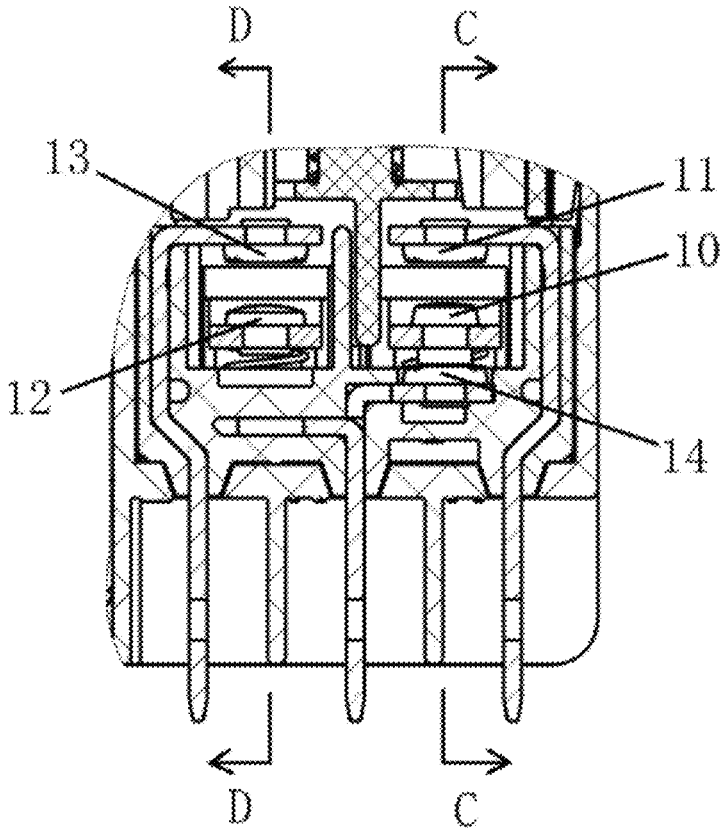
FIG. 21 is a schematic structural view of a cross-sectional view of a contact mechanism of the electromagnetic switch provided by the first aspect of the present application.
Figure 22:
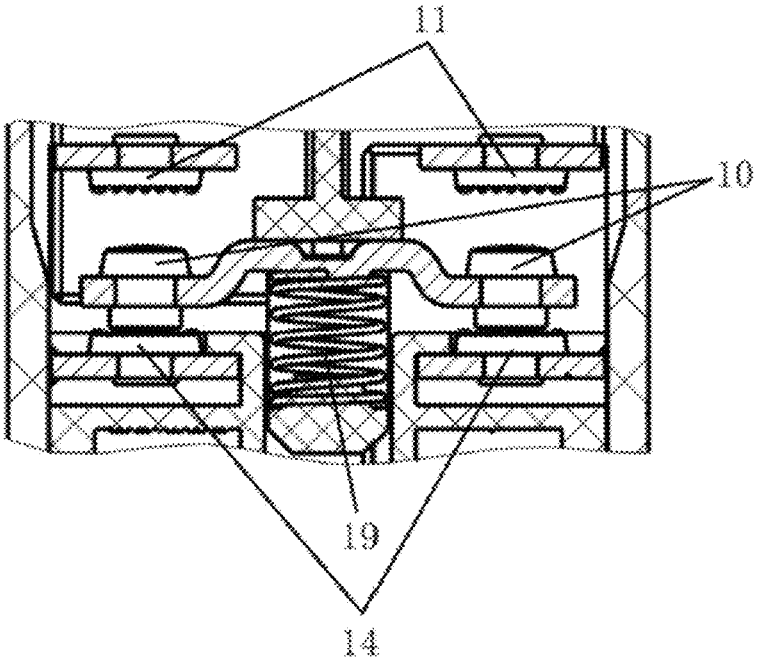
FIG. 22 is a schematic structural view of a cross-sectional view taken along C-C in FIG. 21.
Figure 23:
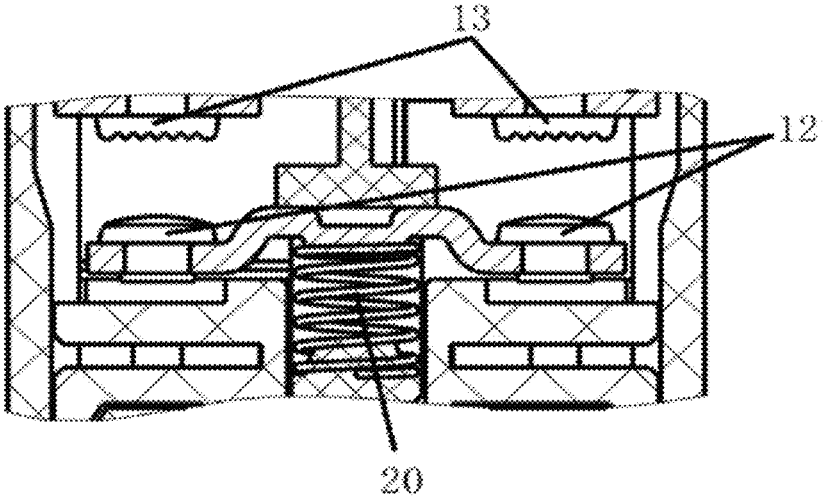
FIG. 23 is a schematic structural view of a cross-sectional view taken along D-D in FIG. 21.
Figure 24:
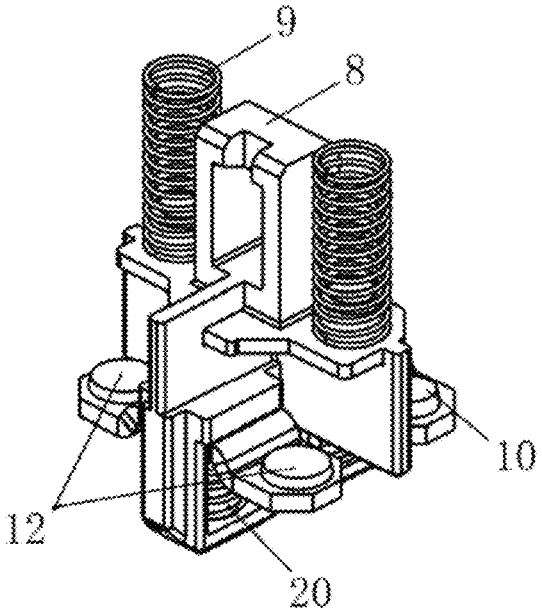
FIG. 24 is a three-dimensional structure diagram of an moving contact holder of the electromagnetic switch provided by the first aspect of the present application.
Figure 25:
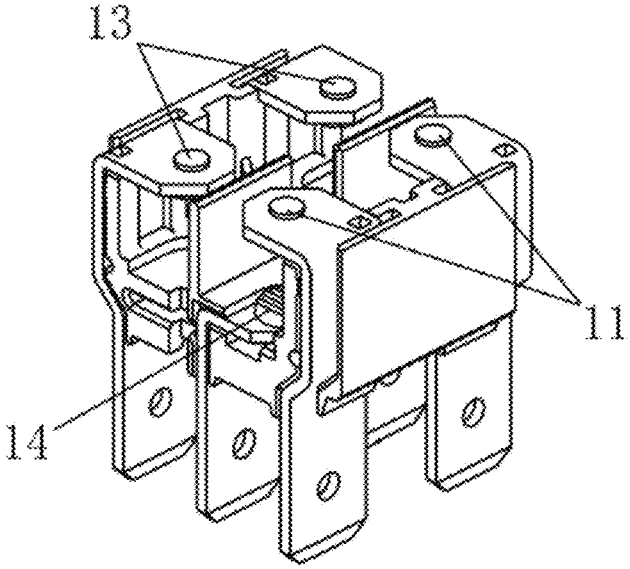
FIG. 25 is a three-dimensional structure diagram of a static contact group of the electromagnetic switch provided by the first aspect of the present application.

As shown in FIG. 19, FIG. 20 and FIG. 26, the electromagnetic component 4 is arranged to correspond to the first button 2 located below the first button 2, and is opposite to the first button 2. The electromagnetic component 4 comprises a coil 5 and an iron core 6 arranged therein, a magnetic force can be generated on the iron core 6 after the coil 5 is energized, so as to adsorb the armature 7 and maintain the attraction state.

The armature 7 has one end located between the electromagnetic component 4 and the jump mechanism, and the other end rotatably connected the electromagnetic component 4 or the housing 1 through the tension spring 28, and can be driven by the jump lever 26 to move toward the electromagnetic component 4 to be connected with the iron core 6 of the electromagnetic component 4. As shown in FIG. 20, FIG. 26, FIG. 31 and FIG. 32, when the first button 2 is not pressed, one end of armature 7 is tilted toward the first button 2, when the first button 2 is pressed, the armature 7 is pressed down by the jump lever 26, so that the armature 7 rotates toward and is connected with the iron core 6 of the electromagnetic component 4. When the iron core 6 no longer attracts the armature 7, the armature 7 is drawn by the tension spring 28 to tilt towards the first button 2, and drives one end of second trip frame 38 near the armature 7 to rotate upward.

The housing 1 is internally provided with a contact mechanism in parallel with the electromagnetic component 4, as shown in FIG. 20, FIG. 26, FIGS. 31-33, the contact mechanism is arranged below the second button 3, and is opposite to the second button 3. The contact mechanism comprises a moving contact holder 8 and a static contact group, referring to FIGS. 21-25, the moving contact holder 8 is arranged in the housing 1 and is able to move up and down therein, the static contact group is fixedly connected in the housing 1, an upper end of the moving contact holder 8 is connected to the housing 1 through a first elastic member 9 which can be a spring, and the moving contact holder 8 can be moved to the bottom position through the first elastic member 9, so that the moving contact group in the moving contact holder 8 is separated or connected to part of the static contact group. The upper end of the moving contact holder 8 is located on the moving path of the second button 3, and the top of the moving contact holder 8 can also be in contact with the second button 3. When being pressed downward, the second button 3 can cause the moving contact holder 8 to move downward. One end of the bridge plate 32 extends into the moving contact holder 8, and when the bridge plate 32 rotates, one end of the bridge plate 32 can tilt the moving contact holder 8 closer to the second button 3, so that the separation or connection between the moving contact group in the moving contact holder 8 and the static contact group is changed.

The moving contact holder 8 comprises: a first moving contact group 10 and a second moving contact group 12 which are electrically connected; a lower part of the first moving contact group 10 is elastically connected to the moving contact holder 8 through the second elastic member 19 which imposes a biasing pressure on the first moving contact group 10 to move it moving upwards; the moving contact holder 8 slides upward, bringing the first moving contact group 10 into contact with the first static contact group 11 on the upper side to maintain electrical connection; the moving contact holder 8 slides down, bringing the first moving contact group 10 into contact with the brake static contact group 14 on the lower side to maintain electrical connection; a lower part of the second moving contact group 12 is in elastic connection with the moving contact holder 8 through the third elastic member 20 which imposes a biasing pressure on the second moving contact group 12 to move it upwards, and the moving contact holder 8 slides upward, bringing the second moving contact group 12 into contact with the second static contact group 13 at the upper side, thereby maintaining electrical connection.

The static contact group is fixed in housing 1, and multiple static contact groups form a cavity that can accommodate the moving contact, including: a first static contact group 11, a second static contact group 13 and a brake static contact group 14, wherein the first static contact and the second static contact are arranged at the upper end of the cavity. After the moving contact holder 8 is inserted among the static contact groups, the first static contact group 11 and the second static contact group 13 are located on one side of the moving contact group near the second button 3; and the brake static contact group 14 is arranged at the lower end of the cavity, that is, located on one side of the moving contact group away from the second button 3.

The brake static contact group 14 and first static contact group 11 share the same moving contact group, when the moving contact holder 8 is elastically pressed by the first elastic member 9 at a lower position, both the first moving contact group 10 and the second moving contact group 12 are moved to a lower position, at this time, the first moving contact group 10 and the first static contact group 11 have an interval therebetween, and electrical contact is made with the brake static contact group 14; and likewise, second moving contact group 12 and the second static contact group 13 have an interval therebetween, i.e., the second moving contact group 12 is disconnected from the second static contact group 13.

Each of the first moving contact group 10, the second moving contact group 12, the first static contact group 11, the second static contact group 13 and the brake static contact group 14 is provided with two symmetrical electrical contacts, of which two electrical contacts of the brake static contact group 14 are used for electrical connection with two terminals of a drive motor. When the two electrical contacts of the brake static contact group 14 are connected, the two terminals of the drive motor can be short-circuited, so as to offset the instantaneous armature current generated by the rotation of the drive motor. The two electrical contacts of the first moving contact group 10, the second moving contact group 12, the first static contact group 11 and the second static contact group 13 can be symmetrical to each other and electrically connected.

After being tilted upward, and the moving contact holder 8 overcomes the elastic force of the first elastic member 9 and moves upward, inside the moving contact holder 8, the first moving contact group 10 and the second moving contact group 12 follow the moving contact holder 8 and conducts upward movement, causing the first moving contact group 10 to be separated from the brake static contact group 14, then the first moving contact group 10 gets in contact with the first static contact group 11 to form electrical connection, and the second moving contact group 12 and the second static contact group 13 also get in contact to form electrical connection; with the first moving contact group 10 and the second moving contact group 12 electrically connected, this action can electrically connect first static contact group 11 and second static contact group 13.

The lower end of the first moving contact group 10 is connected to the moving contact holder 8 through the second elastic member 19. When the electromagnetic component 4 is in a free state without being energized, the moving contact holder 8 is abutted against and pushed to the lowest position under the action of the first elastic member 9. The first moving contact group 10 follows the moving contact holder 8 to move downward, while the first moving contact group 10 is kept at a distance from the first static contact group 11 and keeps in contact with the brake static contact group 14.

The lower end of the second moving contact group 12 is connected to the moving contact holder 8 through the third elastic member 20. When the electromagnetic component 4 is in a free state without being energized, the moving contact holder 8 is abutted against and pushed to the lowest position under the action of the first elastic member 9. The second moving contact group 12 follows the moving contact holder 8 to move downward, while the second moving contact group 12 is kept at a distance from second static contact group 13.

The working process of electromagnetic switch is shown in FIGS. 26-33:

After the first button 2 is pressed down, the jump lever 26 moves downward, the bridge plate abutting end 43 abuts against the bridge plate 32 and pushes the bridge plate 32 to rotate, when the bridge plate 32 rotates until the bridge plate 32 abuts against the first trip frame 33, the bridge plate 32 is in the first locked state, and the jump lever 26 no longer moves. The first button 2 is kept pressing down, the jump spring 27 begins to store energy, and the first button 2 moves until the push rod 24 abuts against the first trip frame 33 and the first trip frame 33 rotates, and a first locking end 37 of the first trip frame 33 gradually moves relative to the first locked face 36 until it moves to the critical state, and the jump spring 27 is in an energy-storing state; after the first trip frame 33 moves to the critical state when the first locked face 36 and the first locking end 37 are separated, i.e., in the unlocked state, the elastic force released from the energy stored by the jump spring 27 acts on the jump lever 26, and the jump lever 26 moves quickly to push the bridge plate 32 to rotate quickly, and the armature abutting end 44 of the jump lever 26 abuts against the armature 7 and drives the armature 7 to move towards iron core 6, so as to connect the armature 7 with the iron core 6.

Meanwhile, when the bridge plate 32 is driven by the jump lever 26 to rotate rapidly, the other end of the bridge plate 32 is tilted to drive the moving contact holder 8 to move upward, so that the moving contact holder 8 overcomes the elastic force of the first elastic member 9 and moves upward, after which the first moving contact group 10 and the second moving contact group 12 follow the upward movement, thereby causing the first moving contact group 10 to be disengaged from brake static contact group 14 and get into contact with first static contact group 11, thus the second moving contact group 12 gets in contact with the second static contact group 13, bringing the motor into operation, and the coil 5 of the electromagnetic component 4 is energized, allowing the iron core 6 to remain attractive to the armature 7.

Figure 31:
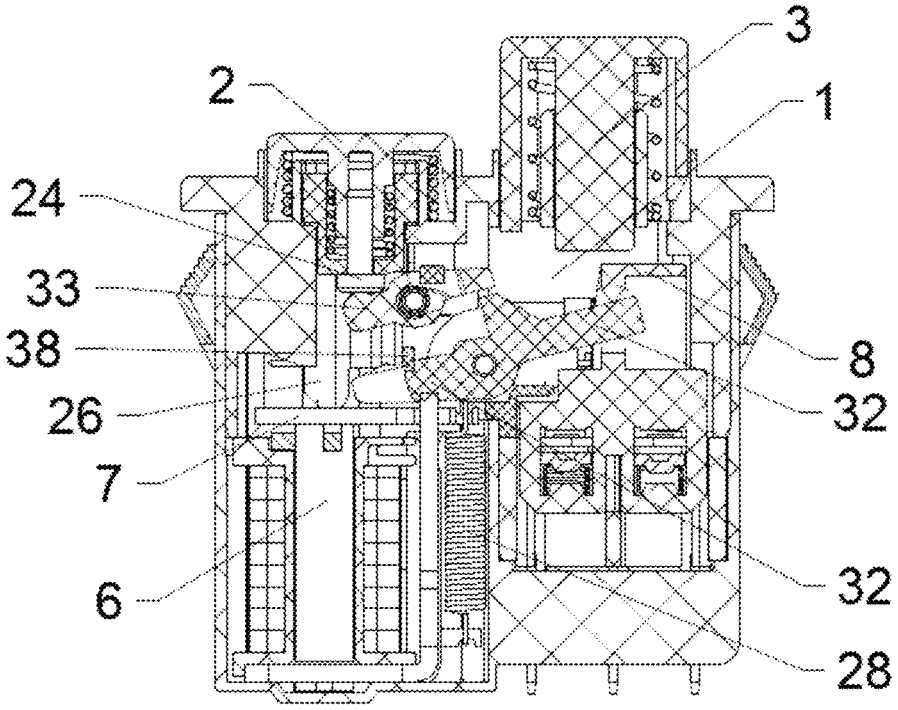
FIG. 31 is a schematic structural view of a cross-sectional view of the electromagnetic switch when the trip mechanism of the electromagnetic switch provided by the first aspect of the present application jumps and the trip mechanism is in the second locked state.

When the first button 2 continues to be pressed, as shown in FIG. 31, the push rod 24 continues to push the first trip frame 33 to move. At this time, the first trip frame 33 is in an idle stoke, and does not abut against the bridge plate 32, the torsion force the torsion spring 41 imposes on the second trip frame 38 increases, making the abutting force between the second trip frame 38 and the bridge plate 32 increase, while the second trip frame 38 does not rotate.

When being no longer pressed down, the first button 2 is automatically restored under the effect of restoration spring 23, completing the connection of the electromagnetic switch.

When the second button 3 is pressed down, the first pressing end 45 thereof pushes the second trip frame 38 to rotate, so that the second trip frame 38 is released free and no longer locked by the bridge plate 32, after the bridge plate 32 is set free, the moving contact holder 8 moves downward under the action of the first elastic member 9. After the second button 3 is released, the second button 3 can spring up under the action of spring, and the moving contact holder 8 is kept at the lowest position under the action of the first elastic member 9. At this time, the second moving contact group 12 in the moving contact holder 8 is separated from the second static contact group 13, the first moving contact group 10 is separated from the first static contact group 11, and the first moving contact group 10 is in contact with the brake static contact group 14, so that the coil 5 of the electromagnetic component 4 is powered off and the motor is powered off, after which the two terminals of the motor are short-circuited immediately.

After the bridge plate 32 is set free, regardless of whether to continue pressing the second button 3, the moving contact holder 8 moves down under the action of the first elastic member 9 and is powered off. When the second moving contact group 12 and the second static contact group 13, or the first the moving contact group 10 and the first static contact group 11 are sintered, the second button 3 can continue to be pressed to push the moving contact holder 8 to move downward, forcing the moving contact holder 8 to move downward and separate from the static contact group.

When power failure occurs, the armature 7 is no longer attracted by the iron core 6 and rotates upward under the action of the tension spring 28, and is no longer locked with the second trip frame 38 after separation therefrom, and after the bridge plate 32 is set free, the moving contact holder 8 moves down under the action of first elastic member 9, allow disconnection the electromagnetic switch.

Figure 34:
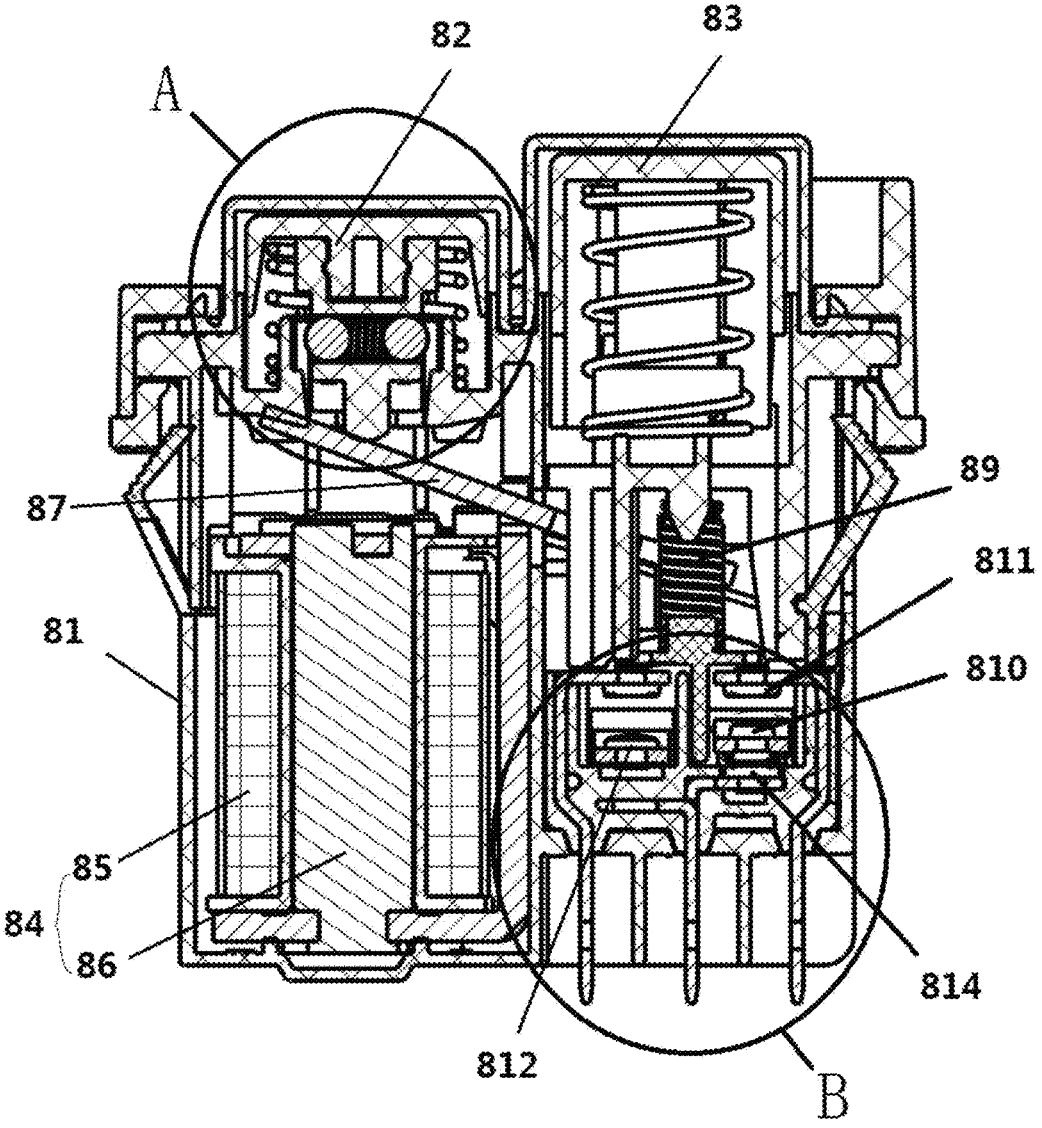
FIG. 34 is a front cross-sectional view of an embodiment of an electromagnetic switch provided by a second aspect of the present application.
Figure 47:
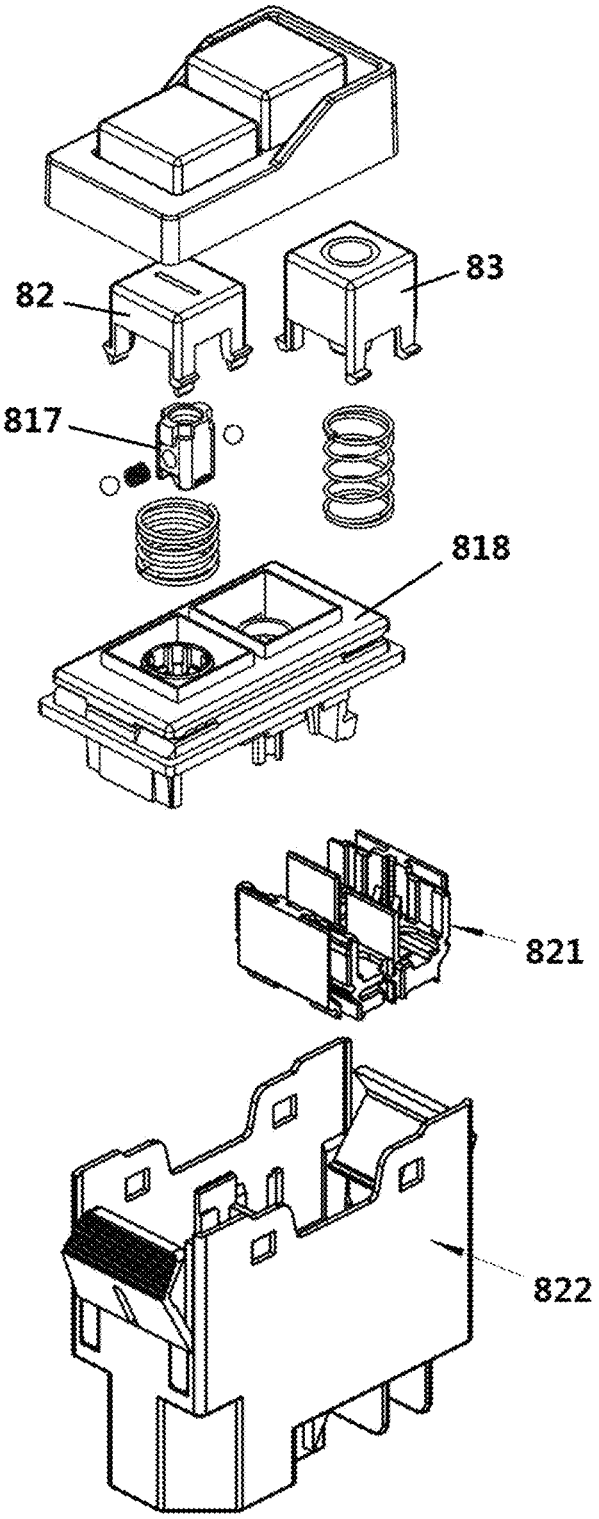
FIG. 47 is an exploded view of the three-dimensional structure of partial structure of the electromagnetic switch provided by the second aspect of the present application.

As shown in FIG. 34, a specific embodiment of an electromagnetic switch provided by the second aspect of the present application includes: a housing 81, a first spring button 82 provided on the housing 81, and a second spring button 83 provided on the housing 81. It should be noted that, as shown in FIG. 47, the housing 81 of the in this embodiment is composed of a panel 818, a fixing base 821 and a base 822, wherein the fixing base 821 can be used to fixedly connect the static contact group, and then fixed in the base 822 via plugging, and the panel 818 is also fixedly connected to the top of the base 822 by plugging.

The housing 81 is provided with an electromagnetic component 84 which is arranged below the first spring button 82, and opposite to the first spring button 82. The electromagnetic component 84 comprises a coil 85 and the iron core 86 arranged in the coil 85, energization of the coil 85 can cause the iron core 86 to generate a magnetic force to attract the armature 8.

The housing 81 is internally provided with a contact mechanism which is arranged below the second spring button 83, and opposite to the second spring button 83. The contact mechanism comprises a moving contact holder 88 arranged in the housing 81 and adapted to move up and down relatively, and a static contact group fixedly connected in the housing 81, an upper end of the moving contact holder 88 is connected to the housing 81 through a first elastic member 89 which can be a spring and move the moving contact holder 88 to the bottom position, so that the moving contact group in the moving contact holder 88 is separated or connected to part of the static contact group. The top of the moving contact holder 88 can also be in contact with the second spring button 83, which, when being pressed down, causes the moving contact holder 88 to move downward. One end of the armature 87 can be in contact and fitted with the moving contact holder 88, after the iron core 86 of the electromagnetic component 84 generates a magnetic force and attracts the armature 87, one end of the armature 87 can tilt the moving contact holder 88 in a direction near the second spring button 83, thereby changing the separation or connection state between the moving contact group in the moving contact holder 88 and the static contact group.

The moving contact holder 88 is internally provided with a first moving contact group 810 and a second moving contact group 812 which are electrically connected; a lower part of the first moving contact group 810 is elastically connected to the moving contact holder 88 through a second elastic member 819 which applies a biasing pressure on the first moving contact group 810 to move it upward. Upward sliding of the moving contact holder 88 brings the first moving contact group 810 into contact with the upper first static contact group 811, thereby maintaining electrical connection, and downward sliding of the moving contact holder 88 brings the first moving contact group 810 into contact with the lower brake static contact group 814, thereby maintaining electrical connection. A lower part of the second moving contact group 812 is flexibly connected with the moving contact holder 88 through the third elastic member 820 which imposes a biasing pressure on the second moving contact group 812 to move it upward. Upward sliding of the moving contact holder 88 can bring the second moving contact group 812 into contact with the upper second static contact group 813, thereby maintaining electrical connection.

Figure 44:
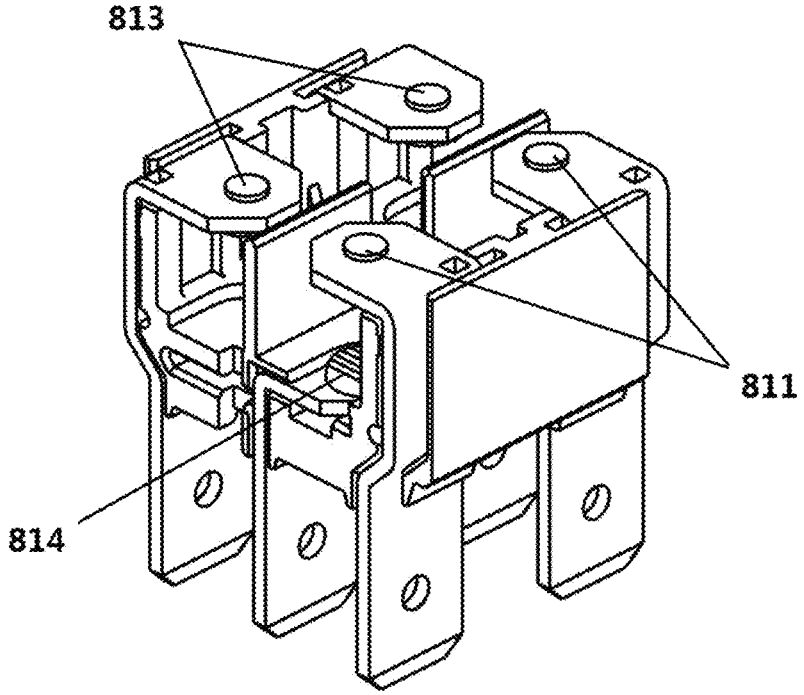
FIG. 44 is a schematic view of a three-dimensional structure of a static contact group of the electromagnetic switch provided by the second aspect of the present application.

As shown in FIG. 44, the static contact group is fixed in the housing, and multiple static contact groups form a cavity that can accommodate the moving contact, including: a first static contact group 811, a second static contact group 813, and a brake static contact group 814, where the first static contact group 811 and the second static contact group 813 are arranged at the upper end of the cavity, after the moving contact holder 88 is inserted between the static contact groups, the first static contact group 811 and the second static contact group 813 are located on one side of the moving contact group near the second spring button 83; and the brake static contact group 814 is arranged at the lower end of the cavity, that is, on the side of the moving contact group away from the second spring button 83.

The brake static contact group 814 and the first static contact group 811 share the same moving contact group. When the moving contact holder 88 is elastically pressed by the first elastic member 89 at a lower position, both the first moving contact group 810 and second moving contact group 812 are moved to a lower position, at this time, the first moving contact group 810 and the first static contact group 811 have an interval therebetween, and electrical contact is made with brake static contact group 814; and likewise, second moving contact group 812 and the second static contact group 813 have an interval therebetween.

Each of the first moving contact group 810, the second moving contact group 812, the first static contact group 811, the second static contact group 813 and the brake static contact group 814 is provided with two symmetrical electrical contacts, of which two electrical contacts of the brake static contact group 814 are used for electrical connection with two terminals of a drive motor. When the two electrical contacts of the brake static contact group 814 are connected, the two terminals of the drive motor can be short-circuited, so as to offset the instantaneous armature current generated by the rotation of the drive motor. The two electrical contacts of the first moving contact group 810, the second moving contact group 812, the first static contact group 811 and the second static contact group 813 can be symmetrical to each other and electrically connected.

In the housing 81, a middle part of the armature 87 is rotatably connected on the housing 81, with one end extending between the first spring button 82 and the electromagnetic component 84. When the first spring button 82 is not pressed, one end of the armature 87 tilts towards the first spring button 82. When the first spring button 82 is pressed, the armature 87 is pressed down, so that the armature 87 moves toward the iron core 86 of the electromagnetic component 84, with the central part as a pivot point. The other end of the armature 87 extends to the side of the second spring button 83 and gets into contact with the moving contact holder 88 of the contact mechanism, specifically, one end of the armature 87 is inserted into the upper end of the moving contact holder 88 to be contacted and fitted. During the process when one end of armature 87 approaches the iron core 86, the other end of the armature 87 tilts the moving contact holder 88 upward, after the moving contact holder 88 overcomes the elastic force of the first elastic member 89 and moves upward, inside the moving contact holder 88, the first moving contact group 810 and the second moving contact group 812 follow the moving contact holder 88 and conducts upward movement, causing the first moving contact group 810 to be separated from the brake static contact group 814, then the first moving contact group 810 gets in contact with the first static contact group 811 to form electrical connection, and the second moving contact group 812 and the second static contact group 813 also get in contact to form electrical connection; with the first moving contact group 810 and the second moving contact group 812 electrically connected, this action can electrically connect the first static contact group 811 and the second static contact group 813.

Figure 35:
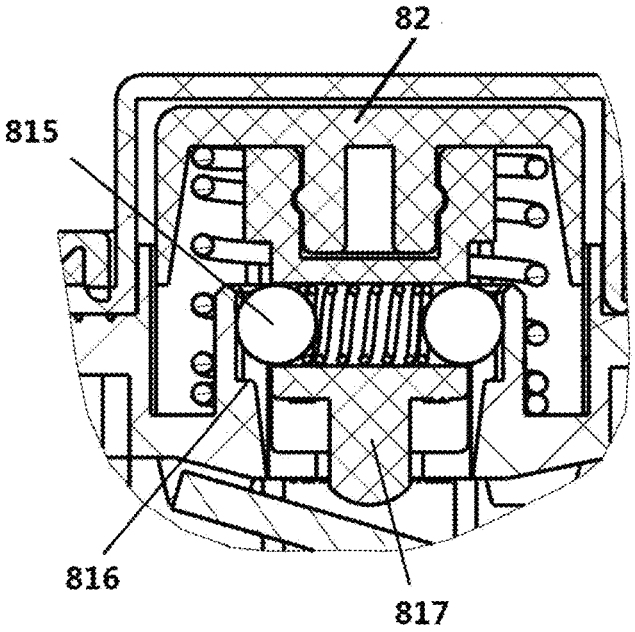
FIG. 35 is an enlarged view of an area A in FIG. 34.

As shown in FIG. 35, a jump structure is arranged in the first spring button 82, comprising: a steel ball 815 as a blocker, a spring for pushing the steel ball 815 toward the push bar 817, and a boss 816 arranged on a sliding path of the push bar 817. The push bar 817 is part of the first spring button 82, and connected below the push end of the first spring button 82. A spring is sleeved on the outside of the push bar 817, the spring has one end abutting below a pressing end of the first spring button 82, and the other end abutting against the housing 81, and is used to keep the first spring button 82 popping up in the free state.

In this embodiment, two steel balls are provided symmetrically, a spring is arranged horizontally to extends through the interior of the push bar 817, two ends of the spring individually push against a steel ball, so that both steel balls can be kept partially pushed out. As an alternative embodiment, more than two steel balls can also be provided, and can be replaced with other components provided with a curved structure on the outer surface, such as conical components.

Figure 36:
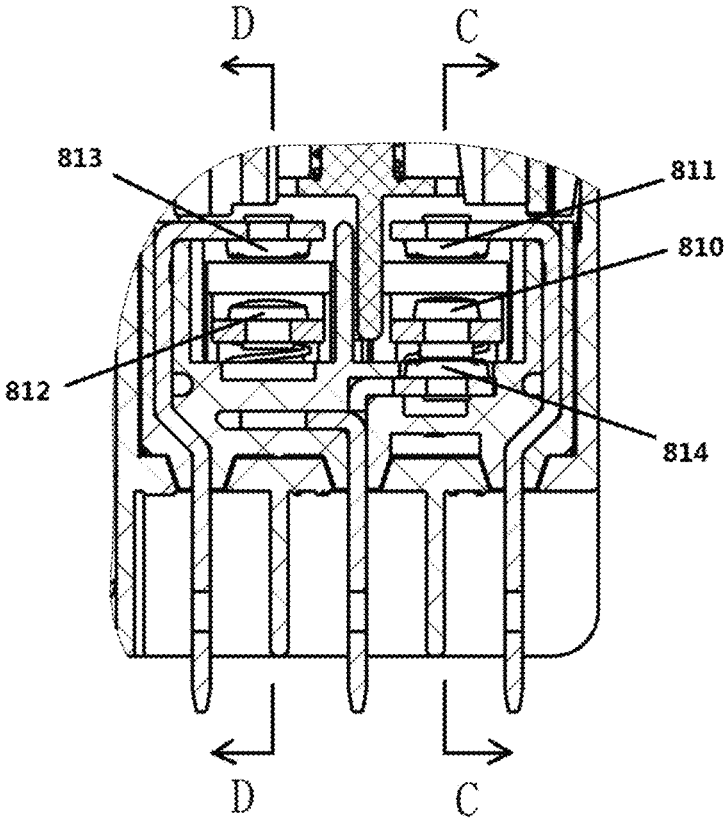
FIG. 36 is an enlarged view of an area B in FIG. 34.
Figure 37:
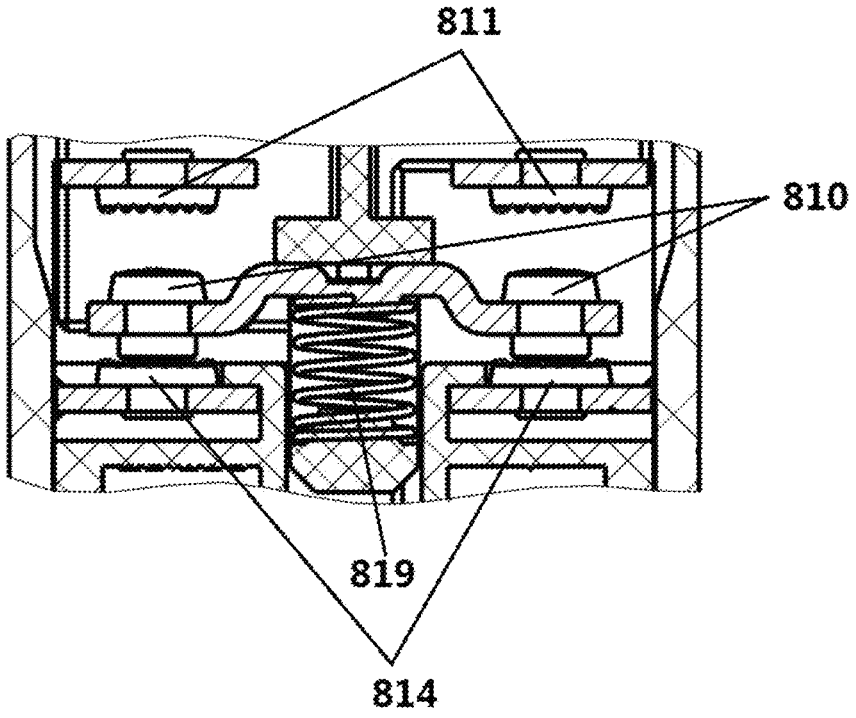
FIG. 37 is a sectional view taken along line C-C in FIG. 36.

As shown in FIG. 36 and FIG. 37, the lower end of the first moving contact group 810 is connected to the moving contact holder 88 through the second elastic member 819. When the electromagnetic component 84 is not energized and thus in a free state, the moving contact holder 88 is pushed to the lowest position under the action of the first elastic member 89, and the first moving contact group 810 follows the downward movement. At this time, the first moving contact group 810 is kept at a distance from the first static contact group 811, and keeps in contact with the brake static contact group 814.

Figure 38:
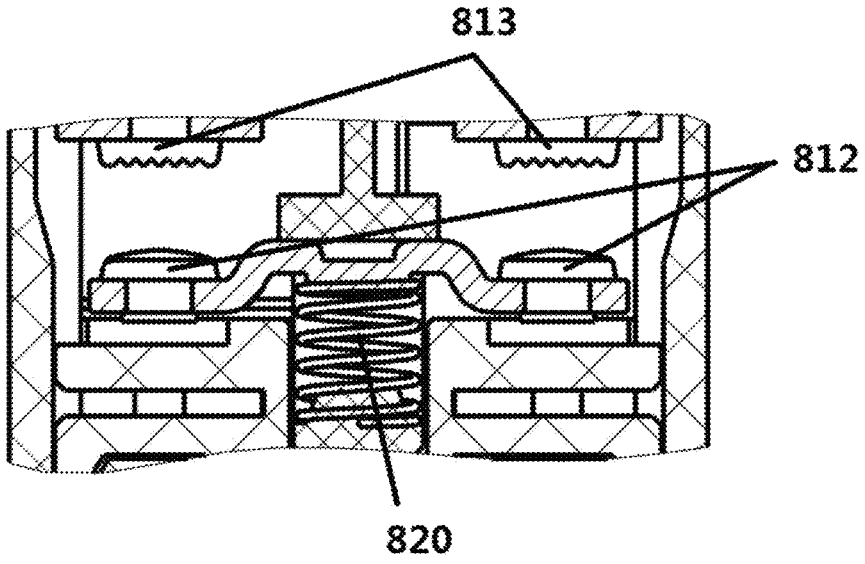
FIG. 38 is a sectional view taken along line D-D in FIG. 36.

As shown in FIG. 36 and FIG. 38, the lower end of the second moving contact group 812 is connected to the moving contact holder 88 through the third elastic member 820. When the electromagnetic component 84 is not energized and thus in a free state, the moving contact holder 88 is pushed to the lowest position under the action of the first elastic member 89, and the second moving contact group 812 follows the downward movement. At this time, the second moving contact group 812 is kept at a distance from the second static contact group 813.

Figure 39:
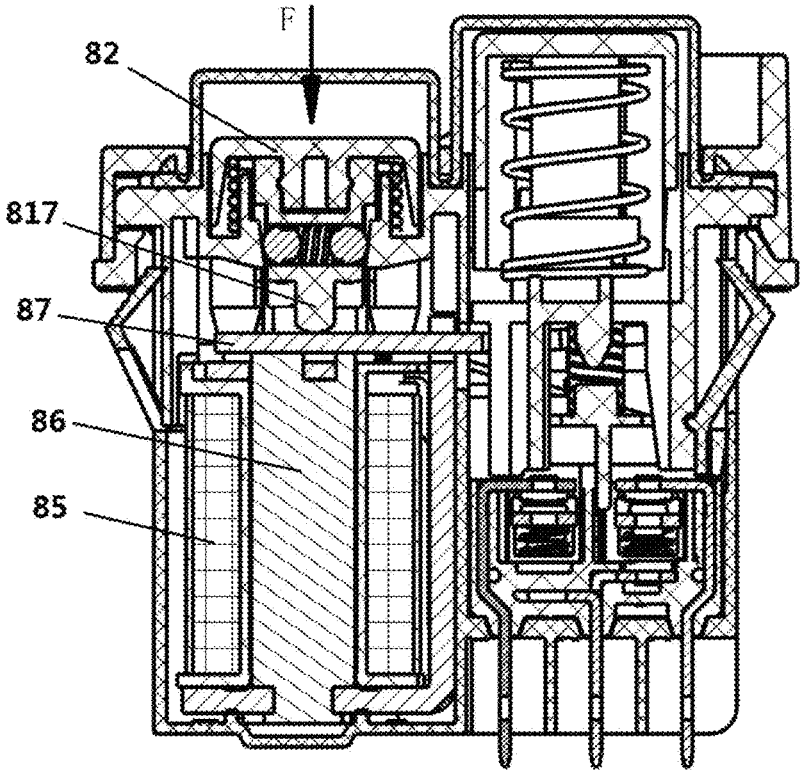
FIG. 39 is a schematic view of the first spring button in FIG. 34 after being pressed.
Figure 46:
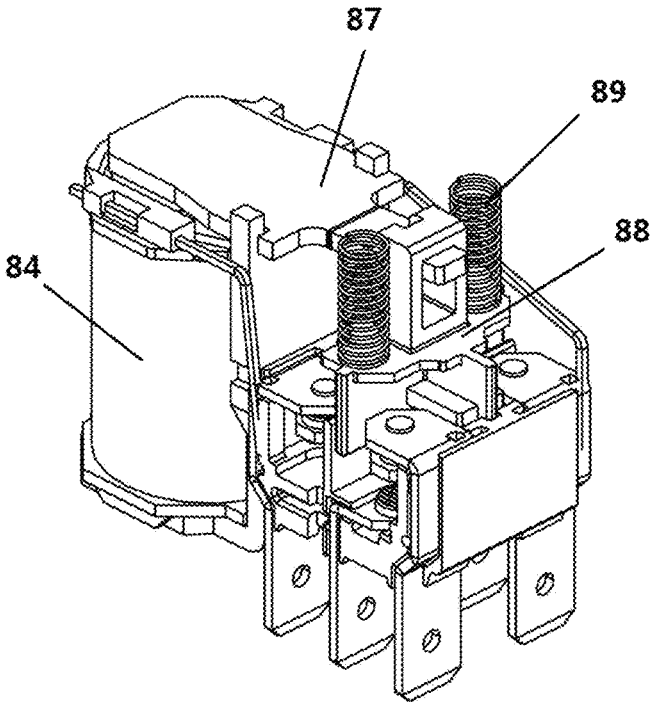
FIG. 46 is a schematic view of the three-dimensional structure of FIG. 45 after the first spring button is pressed.

As shown in FIG. 39 and FIG. 46, after the first spring button 82 is pressed down, the bottom end of the push bar 817 gets in contact with the armature 87 and pushes the armature 87 downward to make it rotate counterclockwise with the middle position as a fulcrum. Therefore, the left end of the armature 87 near the electromagnetic mechanism 84 is in contact with the iron core 86, and the right end thereof near the moving contact holder 88 pries the moving contact holder 88 upward, so that the moving contact holder 88 overcomes the elastic force of the first elastic member 89. After the moving contact holder 88 moves upward, the first moving contact group 810 and the second moving contact group 812 follow the upward movement, allowing the first moving contact group 810 to be separated from the brake static contact group 814 and get into contact with the first static contact group 811, and allowing the second moving contact group 812 to get into contact with the second static contact group 813, so that the motor can run, the coil 85 of the electromagnetic component 84 is energized, enabling the iron core 86 to keep attracting the armature 87.

Figure 40:
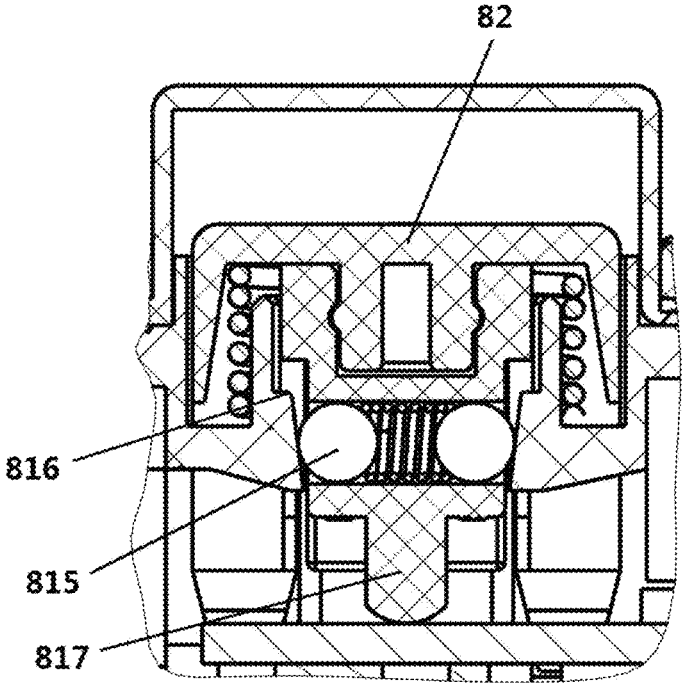
FIG. 40 is an enlarged view of an area E in FIG. 39.

As shown in FIG. 40, after the first spring button 82 is pressed down, the steel ball 815 has moved down to the lowermost end driven by the push bar 817. And during the process that the steel ball 815 moves from the uppermost end to the lowermost end, when moving down along with the push bar 817, the steel ball 815 first gets into contact with the boss 816 on the moving path of the pushing bar 817, as a part of the steel ball 815 was pushed out of the push bar 817 by the spring. Blocked by the boss 816, the first spring button 82 encounters a certain resistance when being pressed down, and once the resistance brought by the boss 816 is overcome by the force of pressing the first spring button 112 downward, the steel ball 815 climbs over the boss 816, so that the push bar 817 can move downward with a large speed, enables the first spring button 82 to be pressed into place once for all.

Figure 41:
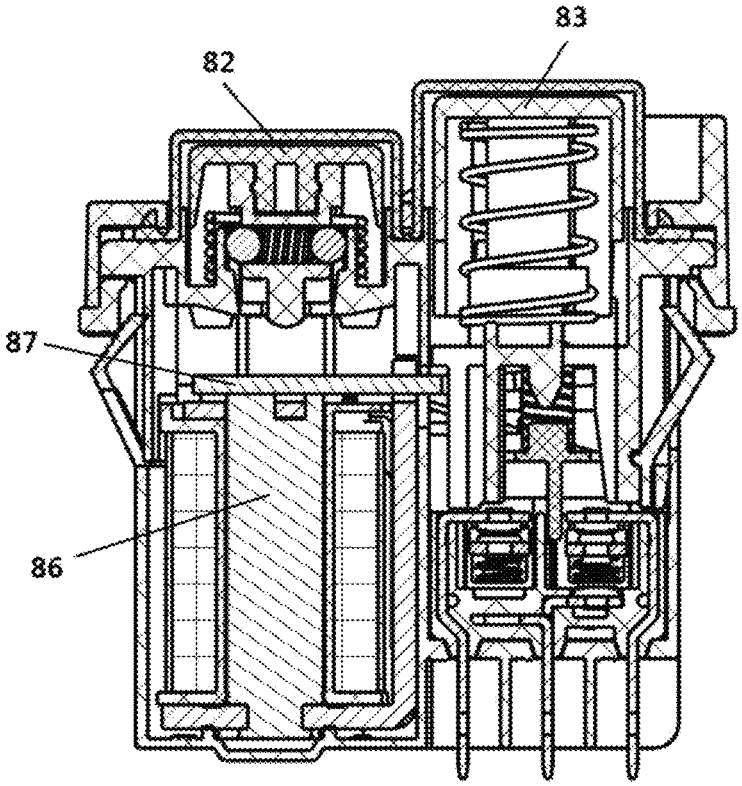
FIG. 41 is a schematic view of the first spring button in FIG. 39 after popping up.

As shown in FIG. 41, after the armature 87 is pressed down, the first spring button 82 makes automatic restoration under the action of the spring, and the iron core 86 can attract one end of the armature 87 since the coil 85 of the electromagnetic component 84 is already charged, so that the other end of the armature 87 keeps the moving contact holder 88 tilted.

Figure 42:
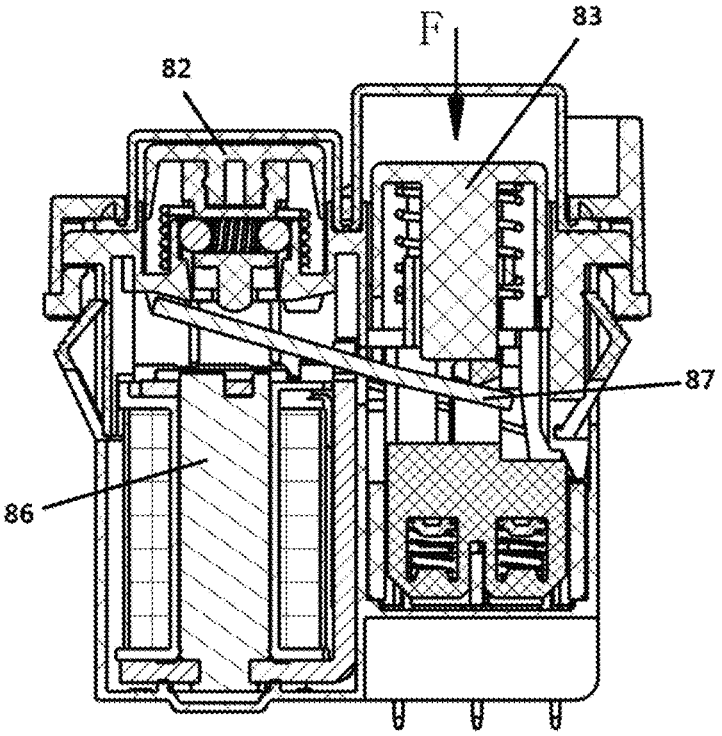
FIG. 42 is a schematic view of the second spring button in FIG. 41 after being pressed.
Figure 45:
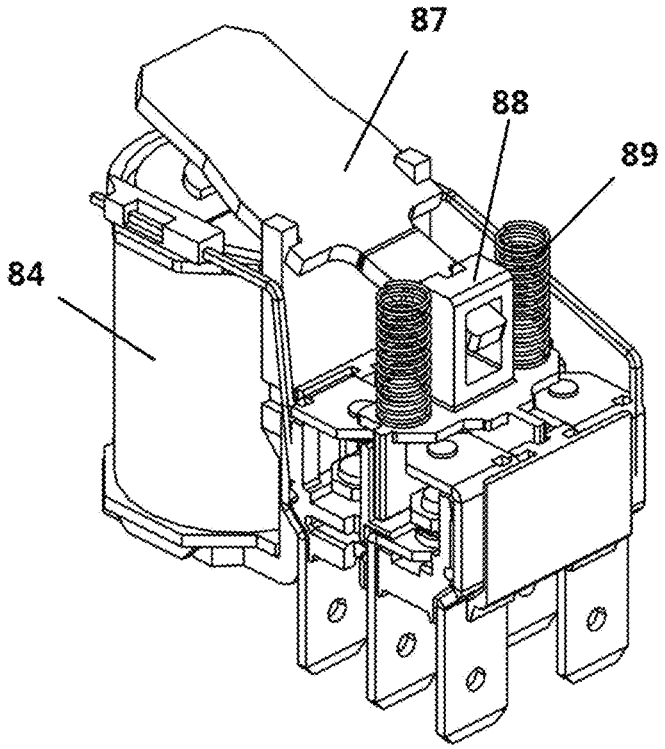
FIG. 45 is a schematic view of a three-dimensional structure of an internal switch structure of the electromagnetic switch provided by the second aspect of the present application.

As shown in FIG. 42 and FIG. 45, after being pressed downward, the second spring button 83 can push the moving contact holder 88 to move downward, so as to drive the armature 87 to rotate downward clockwise with its middle portion as a pivot. One end of armature 87 near the electromagnetic mechanism 84 is tilted upward, so that the armature 87 is detached from the iron core 86. After being released, the second spring button 83 can make upward restoration and spring up under the action of the spring, and the moving contact holder 88 is held at the lowermost position under the action of the first elastic member 89. And one end of the armature 87 near the electromagnetic mechanism 84 is tilted toward the first spring button 82 when the attraction force by the iron core 86 vanishes. At this point, the second moving contact group 812 in the moving contact holder 88 is separated from the second static contact group 813, the first moving contact group 810 is separated from the first static contact group 811, and the first moving contact group 810 gets into contact with the brake static contact group 814, thereby de-energizing the coil 85 of the electromagnetic component 84 and de-energizing the motor, and short-circuiting two terminals of the motor immediately.

Figure 43:
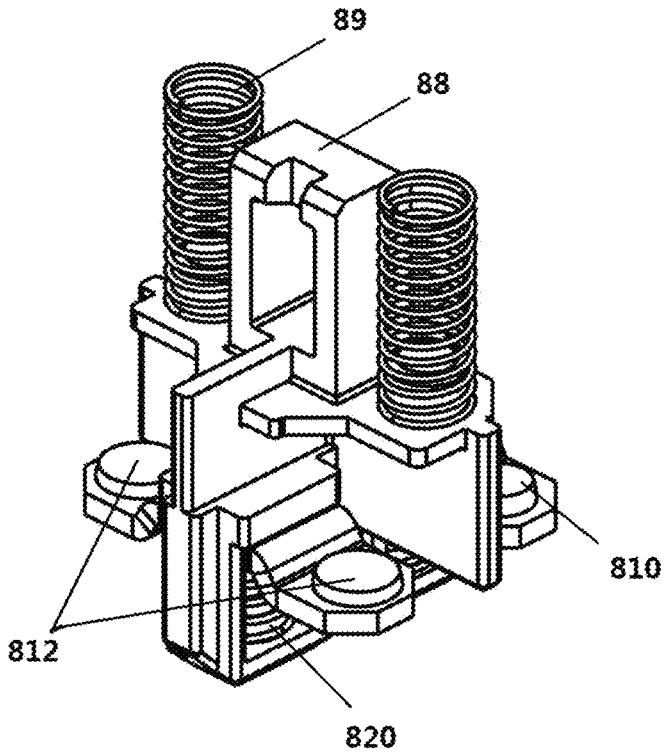
FIG. 43 is a schematic view of a three-dimensional structure of a moving contact holder of the electromagnetic switch provided by the second aspect of the present application.

As shown in FIG. 43, two symmetrical first elastic members 89 are provided on the upper two sides of the moving contact holder 88. The first elastic member 89 abuts against the panel 818, so that the moving contact holder 88 is kept pressing at the lowermost position on its moving path. The moving contact holder 88 is internally connected to the moving contact group through the spring, e.g., a lower end of the second moving contact group 812 is connected to the moving contact holder 88 through a third elastic member 820, thus the second moving contact group 812 is in contact with the interior of the moving contact holder 88 in an elastic sliding manner.

As shown in FIG. 47, the first spring button 82 and the second spring button 83 are arranged above the panel 818 by a spring, and the first spring button 82 can pass through the panel 818 via the push bar 817 to get into contact with the electromagnetic mechanism below; a push rod is correspondingly provided below the second spring button 83, which can pass through the panel 818 to get into contact with and fitted with the moving contact holder 88 below. The first elastic member 89 connected above the moving contact holder 88 is in contact with the bottom of the panel 818, so that the first elastic member 89 can provide a constant force to push the moving contact holder 88 downward. The bottom of panel 818 can be fixed by connecting with a base.

Obviously, the above embodiments are merely intended to clearly illustrate rather than limit the numerated implementations. For one with ordinary skill in the art, other different forms of modifications or changes may further be made on the basis of the aforementioned descriptions. It is unnecessary and impossible to exhaust all implementations. And modifications or changes derived herefrom obviously fall into the protection scope of the present invention.

What is claimed is:

1. An electromagnetic switch, comprising:

a housing;

a jump mechanism, movably arranged on the housing;

a trip mechanism, arranged on the housing and opposite to the jump mechanism, adapted to move relative to the housing, and comprising a bridge plate located on a moving path of the jump mechanism and having multiple locked states, unlocked states, and critical states when shifting from the locked state to the unlocked state;

the jump mechanism is adapted to abut against the bridge plate when moving downward, push the bridge plate to move to the locked state, store energy by continuing moving to drive the trip mechanism to move to the critical state, and cause the jump mechanism to jump to connect a circuit with the energy stored in the unlocked state, wherein the jump mechanism comprises a jump body, a push rod fixedly arranged on the jump body, and a jump lever connected with the jump body through a jump biasing member, the trip mechanism further comprises a first trip frame located on a moving path of the push rod, the bridge plate is arranged on a moving path of the jump lever, and the bridge plate is in a first locked state when the first trip frame abuts against the bridge plate, the jump lever is adapted to abut against the bridge plate and push the bridge plate to move to the first locked state when the jump mechanism moves downward, the push rod is adapted to drive the first trip frame to move via continuing movement of the jump mechanism, and the jump biasing member is adapted to store energy during movement to the critical state, and cause the jump lever to jump to connect the circuit with the energy stored in the unlocked state.

2. The electromagnetic switch of claim 1, wherein the push rod is integrally formed with the jump body, an end of the push rod away from the jump body is provided with multiple guide protrusions;

the jump lever is provided with multiple guide holes for multiple guide protrusions to pass through, as well as a support surface, and the support surface is adapted to abut against the guide protrusion after the push rod rotates over a preset angle.

3. The electromagnetic switch of claim 2, wherein an upper surface of the bridge plate is provided with a first curved surface, and a second curved surface in stepped connection with the first curved surface, the first curved surface is located on one side near the second curved surface, a height of the first curved surface is greater than that of the second curved surface, a step face between the first curved surface and the second curved surface is a first locked face, one end of the first trip frame moves on the first curved surface and the second curved surface and is adapted to be fitted on the first locked face.

* * * * *